US007482312B2

(12) United States Patent
Bastien et al.

(10) Patent No.: US 7,482,312 B2
(45) Date of Patent: Jan. 27, 2009

(54) ENGINE OILS FOR RACING APPLICATIONS AND METHOD OF MAKING SAME

(75) Inventors: Paul F. Bastien, Katy, TX (US); David J. Kushner, Katy, TX (US); Peter Sant, Chester (GB)

(73) Assignee: Shell Oil Company, Houston, TX (US)

( * ) Notice: Subject to any disclaimer, the term of this patent is extended or adjusted under 35 U.S.C. 154(b) by 731 days.

(21) Appl. No.: 11/096,471

(22) Filed: Apr. 1, 2005

(65) Prior Publication Data

US 2006/0223718 A1 Oct. 5, 2006

(51) Int. Cl.
*C10M 141/10* (2006.01)

(52) U.S. Cl. ..... 508/365

(58) Field of Classification Search ..... 508/365
See application file for complete search history.

(56) References Cited

U.S. PATENT DOCUMENTS

| | | | | |
|---|---|---|---|---|
| 3,595,791 | A | 7/1971 | Cohen | |
| 3,960,706 | A | 6/1976 | McCollum et al. | 208/112 |
| 4,127,470 | A | 11/1978 | Baird, Jr. et al. | 208/58 |
| 4,537,691 | A | 8/1985 | Mori et al. | |
| 4,609,456 | A | 9/1986 | Deschamps et al. | 208/112 |
| 4,652,386 | A | 3/1987 | Alberts et al. | |
| 4,692,256 | A | 9/1987 | Umemura et al. | |
| 4,749,505 | A | 6/1988 | Chung et al. | |
| 4,798,684 | A | 1/1989 | Salomon | |
| 4,853,139 | A | 8/1989 | Ichihashi | |
| 4,900,462 | A | 2/1990 | Haag et al. | |
| 4,956,122 | A | 9/1990 | Watts et al. | |
| 5,084,197 | A | 1/1992 | Galic et al. | |
| 5,105,038 | A | 4/1992 | Chen et al. | |
| 5,118,433 | A | 6/1992 | Chung et al. | |
| 5,130,041 | A | 7/1992 | Groenhof | |
| 5,210,346 | A | 5/1993 | Dileo | |
| 5,322,633 | A | 6/1994 | Senaratne et al. | |
| 5,358,629 | A | 10/1994 | Tamalis et al. | 208/112 |
| 5,431,832 | A | 7/1995 | Crowe et al. | |
| 5,599,778 | A | 2/1997 | Ishikawa et al. | |
| 5,627,146 | A | 5/1997 | Tanaka et al. | |
| 5,696,065 | A | 12/1997 | Tanaka et al. | |
| 6,071,863 | A | 6/2000 | Benda et al. | |
| 6,103,674 | A | 8/2000 | Nalesnik et al. | |
| 6,114,288 | A | 9/2000 | Fujitsu et al. | |
| 6,232,279 | B1 * | 5/2001 | Steigerwald | 508/591 |
| 6,245,725 | B1 | 6/2001 | Tanaka et al. | |
| 6,268,316 | B1 * | 7/2001 | Tanaka et al. | 508/291 |
| 6,306,801 | B1 | 10/2001 | Yagishita et al. | |
| 6,313,077 | B1 | 11/2001 | Stunnenberg et al. | |
| 6,329,327 | B1 | 12/2001 | Tanaka et al. | |
| 6,399,550 | B1 | 6/2002 | Zehler | |
| 6,444,624 | B1 | 9/2002 | Walker et al. | |
| 6,525,103 | B2 | 2/2003 | Ebbrecht et al. | |
| 6,548,724 | B2 | 4/2003 | Bagheri et al. | |
| 6,569,819 | B2 | 5/2003 | Yagishita et al. | |
| 6,599,865 | B1 | 7/2003 | Esche, Jr. et al. | |
| 6,642,188 | B1 | 11/2003 | Hartley et al. | |
| 6,645,921 | B2 | 11/2003 | Gatto | |
| 6,645,923 | B2 | 11/2003 | Dunn et al. | |
| 6,686,320 | B2 | 2/2004 | Ebbrecht et al. | |
| 6,723,684 | B2 | 4/2004 | Akiyama et al. | |
| 6,723,685 | B2 | 4/2004 | Hartley et al. | |
| 6,734,150 | B2 | 5/2004 | Gao et al. | |
| 6,852,679 | B2 | 2/2005 | Hartley et al. | |
| 2002/0151441 | A1 | 10/2002 | Srinivasan et al. | |
| 2003/0045436 | A1 | 3/2003 | Fu et al. | |
| 2003/0191032 | A1 | 10/2003 | Deckman et al. | |
| 2003/0199399 | A1 | 10/2003 | Hartley et al. | |
| 2003/0207775 | A1 | 11/2003 | Sullivan et al. | |
| 2003/0220206 | A1 | 11/2003 | Komiya et al. | |
| 2003/0236177 | A1 | 12/2003 | Wu et al. | |
| 2004/0033908 | A1 | 2/2004 | Deckman et al. | |

* cited by examiner

*Primary Examiner*—Walter D Griffin
*Assistant Examiner*—Frank C Campanell

(57) ABSTRACT

An automotive racing oil and method of making same, the automotive racing oil comprising base oil comprising polyalphaolefin and racing oil components effective to produce automotive racing oil properties comprising a kinematic viscosity of from about 3.2 centistokes (cSt) to about 25 cSt at 100° C. and a coefficient of friction of about 0.065 or less at 180° C., the automotive racing oil having a molybdenum concentration of more than 360 ppm and a zinc concentration of about 1400 ppm or more, both as measured by X-ray fluorescence, and a quantity of a combination of esters maintaining the racing oil components in solution in the base oil, the combination of esters comprising one or more multiester(s) and one or more polyol monoester(s).

46 Claims, No Drawings

ENGINE OILS FOR RACING APPLICATIONS AND METHOD OF MAKING SAME

FIELD OF THE INVENTION

The present application relates to lubricating oil compositions formulated for racing applications, hereinafter referred to as "racing oils," and to methods for making the racing oils.

BACKGROUND OF THE INVENTION

Lubricating oil protects internal combustion engines from friction, wear, and contaminants. Current practice for formulating racing oils is to modify "conventional oils," or lubricating oils used in passenger vehicles.

"Racing oils" formulated in this manner do not optimally and efficiently meet the performance demands placed on racing oils.

SUMMARY OF THE INVENTION

The invention provides an automotive racing oil comprising base oil comprising polyalphaolefin and racing oil components effective to produce automotive racing oil properties comprising a kinematic viscosity of from about 3.2 centistokes (cSt) to about 25 cSt at 100° C., and a coefficient of friction of about 0.065 or less at 180° C. The racing oil components comprise: one or more oil-soluble molybdenum compound selected from the group consisting of molybdenum dithiocarbamates and molybdenum dithiophosphates, the automotive racing oil having a molybdenum concentration of more than 360 ppm, as measured by X-ray fluorescence; one or more anti-wear additive comprising zinc selected from the group consisting of zinc dihydrocarbyl dithiophosphates and zinc dihydrocarbyl dithiocarbamates, the automotive racing oil having a zinc concentration of about 1400 ppm or more, as measured by X-ray fluorescence; and, a quantity of a combination of esters maintaining the racing oil components in solution in the base oil, the combination of esters comprising one or more multiester(s) and one or more polyol monoester(s).

The invention also provides a method for formulating automotive racing oil comprising providing base oil comprising polyalphaolefin and mixing the base oil with racing oil components under conditions effective to produce the automotive racing oil comprising a kinematic viscosity of from about 3.2 centistokes (cSt) to about 25 cSt at 100° C., and a coefficient of friction of about 0.065 or less at 180° C. The racing oil components consist essentially of: a quantity of one or more oil soluble molybdenum compound(s) effective to produce a molybdenum concentration of more than 360 ppm, as measured by X-ray fluorescence; an amount of anti-wear component comprising zinc effective to produce a zinc concentration of about 1400 ppm or more, as measured by X-ray fluorescence; a quantity of a combination of esters effective to maintain the racing oil components in solution in the base oil; one or more detergent comprising metal having a valence of +2; one or more dispersant comprising nitrogen; one or more antioxidant selected from the group consisting of aminic antioxidant, phenolic antioxidant, and combinations thereof; and, one or more antifoaming agent.

DETAILED DESCRIPTION OF THE INVENTION

In the past, racing oils were formulated using "conventional oils" as a base oil. Conventional oils are used to lubricate engines in passenger vehicles. To formulate a racing oil, a "conventional oil" was simply modified, typically by adding anti-wear and/or antifriction additive(s), in an effort to meet the high performance requirements of racing oils.

Unfortunately, conventional oils contain a number of additives that may be necessary to meet industry specifications applicable to conventional oils, but that are not necessary or even helpful in racing oils. Some of the additives found in conventional oils actually have a negative impact on performance in a racing oil.

Conventional oils and racing oils are exposed to completely different conditions. Passenger vehicles provide transportation over long periods of time under relatively mild conditions. Racing oils are used to lubricate very expensive engines under extremely intense conditions. Racing oils must provide excellent engine protection under high loads at high temperatures over short periods of time.

The present application provides specially formulated racing oils having optimal overall performance. The racing oils are formulated using a base oil comprising polyalphaolefin and using only "racing oil components." Only those additives which provide a performance benefit, or which are required to provide effective racing oil properties are used in the racing oil formulations. Different types of oils for different racing applications are efficiently and effectively formulated to meet the rapid demands of racing teams.

The racing oil comprises base oil, ester, and a sufficient quantity of the racing oil components to provide effective racing oil properties. Effective racing oil properties include, but are not necessarily limited to a specified kinematic viscosity at 100° C. and a coefficient of friction of about 0.065 or less at 180° C. The specified kinematic viscosity of the racing oil at 100° C. will vary with the grade of racing oil. Generally, the specified kinematic viscosity at 100° C. is from about 3.2 centistokes (cSt) to about 25 cSt.

The following grades of racing oil preferably have the following viscometric properties:

| | GRADE | | | | |
|---|---|---|---|---|---|
| | 0W5 | 17.5W35 | 0W20 | 7.5W35 | 15W50 |
| Kinematic Viscosity @ 40° C., cSt (ASTM D 445) | 15.5 | 99.1 | 36.5 | 84.0 | 144.5 |
| Kinematic Viscosity @ 100° C., cSt (ASTM D 445) | 3.60 | 12.50 | 6.50 | 12.50 | 18.50 |
| Viscosity Index (VI) | 115 | 120 | 132 | 146 | 144 |

Generally, the racing oil components include, but are not necessarily limited to a combination of esters, anti-wear additive(s), and friction modifier(s). In a preferred embodiment, the racing oil components are further selected from the group consisting of antioxidants, detergents, dispersants, antifoaming agents, and combinations thereof. Suitably, the racing oil comprises about 6 wt. % or more total racing oil components, up to about 39 wt. % total racing oil components, based on the weight of the racing oil.

The racing oils are provided with sufficient antioxidant to protect the expensive racing engine under the high temperature conditions of a race. Detergents have not been evaluated to determine their specific contribution to performance benefit in racing oils. However, detergent is believed to have minimal impact on the overall performance of racing oils. The racing oils therefore contain a reduced amount of detergent compared to conventional lubricating oils. And, the detergent preferably is selected to provide maximum performance.

The amount of dispersant in the racing oil is minimized and relatively low molecular weight dispersant preferably is used to minimize dispersant viscosity, thereby minimizing the detrimental impact of the dispersant on frictional performance.

Typically the racing oil comprises: from about 1 to about 4 wt. % anti-wear additive; from about 1.1 to about 2.2 wt. % friction modifier; from about 0.5 to about 2.0 wt. % antioxidant; from about 1 to about 4 wt. % detergent; from about 2 to about 6 wt. % dispersant; and from about 0.01 to about 0.025 wt. % antifoaming agent, based on the weight of the racing oil.

In parts per million (ppm), the racing oils generally comprise from 360 ppm to about 1200 ppm Mo and from about 1400 ppm to about 2600 ppm Zn. In preferred embodiments, the racing oil comprises about 500 ppm or more Mo, about 550 ppm to about 2500 ppm calcium, from about 1200 ppm to about 2300 ppm phosphorus, from about 2500 ppm to about 29,300 ppm sulfur (preferably from about 4800 ppm to about 8500 ppm sulfur), and from about 900 ppm to about 2725 ppm nitrogen. In more preferred embodiments, the racing oils comprise about 720 ppm Mo, about 2000 ppm zinc, about 1706 ppm nitrogen, about 900 ppm calcium, and about 1810 ppm phosphorus.

The following is a more detailed discussion of the base oil, the ester, and the racing oil components:

The Base Oil

The racing oil preferably comprises a quantity of base oil comprising polyalphaolefins (PAO). The use of the phrase "consisting essentially of" in connection with the PAO does not exclude the presence of other mineral and/or synthetic oil in a suitable amount, typically up to about 10 wt. %, excluding ester. The quantity of the base oil, excluding ester, generally is about 52 wt. % or more, preferably about 55 wt. % or more, more preferably about 65 wt % or more, generally up to about 89 wt. %, preferably up to about 80 wt. % or more, based on the total weight of the racing oil.

The application and claims are not limited to the use of PAO made by a particular method. In general, PAO basestocks are produced by the polymerization of α-olefins having from about 8 to about 12 carbon atoms, preferably 10 carbon atoms. Polymers of lower olefins such as ethylene and propylene also may be used, including copolymers of ethylene with higher olefins, as described in U.S. Pat. No. 4,956,122 and the patents referred to therein, incorporated herein by reference.

The α-olefins are polymerized in the presence of a suitable catalyst, including but not necessarily limited to $AlCl_3$, $BF_3$, or $BF_3$ complexes, followed by hydrogenation. The PAO may have a wide range of viscosities varying from about 2 $mm^2/s$ (centistokes, cSt) at 100° C. to over 100 cSt at 100° C., as measured by ASTM D 445, incorporated herein by reference.

Examples of suitable commercially available PAO's include, but are not necessarily limited to the following, which are commercially available from BP Chemical: DURASYN 162 (2 cSt PAO); DURASYN 164 (4 cSt PAO); DURASYN 166 (6 cSt PAO); DURASYN 170 (10 cSt PAO). Also useful are SPECTRASYN 40 (40 cSt PAO) and SPECTRASYN 100 (100 cSt PAO), commercially available from ExxonMobil Chemical.

Preferably, the base oil comprises PAO having a viscosity of from about 2 to about 40 cSt at 100° C., as measured by ASTM D 445. The viscosity of the PAO(s) used in the base oil will vary depending upon the desired viscosity of the racing oil. Typically, one or more PAOs, preferably two PAOs, having viscosities of about 2 cSt, 4 cSt, 6 cSt, 10 cSt, and 40 cSt at 100° C. are used at varying ratios to produce base oil having a desired viscosity.

Ester

The racing oil preferably comprises ester as an added component. In a preferred embodiment, the ester is a combination of esters comprising one or more polyol monoester(s) and one or more multiester(s). The combination of esters is effective to maintain the racing oil components in solution in the base oil. The monoester also contributes to friction reduction/lubricity.

Suitable polyol monoesters include, but are not necessarily limited to polyol monoesters having the following general structure:

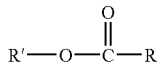

wherein R is selected from the group consisting of alkyl groups and alkenyl groups having about 14 carbon atoms or more, preferably about 20 carbon atoms or less, more preferably about 17 carbon atoms, most preferably an alkenyl group having 17 carbon atoms; and R' is a polyhydric alcohol having from about 3 to about 6 carbon atoms, preferably about 3 carbon atoms.

Exemplary polyol monoesters are selected from the group consisting of glycerol monoesters, trimethylolpropane monoesters, and pentaerythritol monoesters. In a most preferred embodiment, the monoester is a glycerol ester, most preferably glycerol monooleate. Glycerol monooleate is commercially available from a number of sources, including but not necessarily limited to Cognis as EMEREST 2421 (Agnique GMO-U). Commercial polyol monoester(s) generally comprise impurities, which typically are in the form of other esters and/or monoglycerides. The amount of such impurities may be up to about 50 wt. % or less, typically up to about 40 wt. % or less of the polyol monoester(s).

The preferred multiester(s) will vary with the viscosity of the base oil. Where the base oil has a viscosity of from about 2 cSt to about 10 cSt at 100° C., the multiester preferably is a diester having the following general structure:

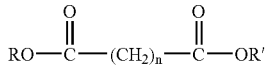

wherein n is from about 4 to about 10, preferably 7; and, R and R' are selected from the group consisting of alkyl groups and alkenyl groups having about 10 carbon atoms or more, preferably about 20 carbon atoms or less, more preferably about 17 carbon atoms or less, most preferably a branched chain alkenyl group having 10 carbon atoms or more. A suitable commercially available diester is PRIOLUBE 3970, available from Uniquema.

Where the base oil has a viscosity of about 10 cSt at 100° C. or more, the multiester preferably is a multicarboxylic acid multiester aromatic compound, preferably a tricarboxylic acid triester aromatic compound wherein the ester group comprises alkyl groups independently having from about 4 to about 18 carbon atoms, preferably from about 10 to about 13 carbon atoms. Preferred aromatic tricarboxylic acid triester compounds include, but are not necessarily limited to isodecyl trimellitate, tridecyl trimellitate, and combinations thereof.

A most preferred combination of esters is a combination of isodecyl trimellitate and tridecyl trimellitate in conjunction with glycerol monooleate. Suitable isodecyl/tridecyl trimellitate is commercially available from Cognis as EMERY 2913-U.

The racing oil preferably comprises from about 5 wt. % to about 22 wt. % of a combination of one or more multiester(s) and one or more polyol monoester(s).

The combination of esters provides from about 0.5 wt. % to about 2 wt. % of the polyol monoester component(s), preferably from about 0.8 wt. % to about 1.5 wt. % polyol monoester component(s), based on the total weight of the racing oil. Where the base oil has a viscosity of from about 2 cSt to about 10 cSt at 100° C., the racing oil preferably comprises about 0.8 wt. % polyol monoester component(s), based on the total weight of the racing oil. Where the base oil has a viscosity of about 10 cSt or more at 100° C., the racing oil preferably comprises about 1.5 wt. % polyol monoester component(s), based on the total weight of the racing oil.

The combination of esters also provides from about 4.5 wt. % to about 20 wt. % of the multiester component(s), preferably from about 10 to about 15 wt. % of the multiester component(s), based on the total weight of the racing oil. Where the base oil has a viscosity of from about 2 cSt to about 10 cSt at 100° C., the racing oil preferably comprises about 10 wt. % of polyol diester component(s), based on the total weight of the racing oil. Where the base oil has a viscosity of from about 2 cSt to about 10 cSt at 100° C., the racing oil preferably comprises about 15 wt. % aromatic multiester component(s), based on the total weight of the racing oil.

Friction Modifier

The racing oil comprises one or more oil-soluble molybdenum compound(s) having friction modifying and/or antiwear properties. The friction modifier produces a concentration of molybdenum in the racing oil of more than 360 ppm, preferably about 500 ppm or more, up to about 1200 ppm, with a preferred concentration of molybdenum being about 720 ppm. Generally, the racing oil is provided with about 1.8 wt. % friction modifier, based on the total weight of the racing oil.

Friction modifiers of all types may be used alone or in combination. The friction modifier, alone or in combination with other components, produces a coefficient of friction at a temperature of about 160° C., of about 0.06 or less and a coefficient of friction of about 0.065 or less, preferably about 0.06 or less, at a temperature of 180° C., as measured using a High Frequency Reciprocating Rig (HFRR), described in more detail in the "Materials and Methods" section preceding the Examples.

The oil-soluble molybdenum compound may be mono-, di-, tri- or tetra-nuclear. Mono and dinuclear molybdenum compounds are preferred. Suitable oil-soluble molybdenum compounds include, but are not necessarily limited to molybdenum dithiocarbamates and molybdenum dithiophosphates. Preferred oil-soluble molybdenum compounds comprise dithiocarbamates and dithiophosphates having the following general structure:

$$(MoXY)_a[S\text{-}Z]_n$$

wherein a is from 1 to 2; n is 2; X and Y are selected from the group consisting of oxygen, sulfur, and nothing; and, Z is selected from groups having the following general structure:

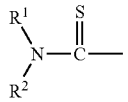

1)

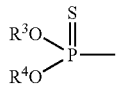

2)

wherein $R^1$ to $R^4$ independently are selected from the group consisting of alkyl groups, aryl groups, aralkyl groups, alkoxyalkyl groups, cycloalkyl groups, and cycloalkenyl groups generally having from 1 to about 30 carbon atoms, preferably having from about 2 to 12 carbon atoms. In a preferred embodiment, $R^1$ and $R^2$ are alkyl groups having from about 2 to 12 carbon atoms. Examples of suitable compounds are described in detail in U.S. Pat. No. 6,268,316, incorporated herein by reference.

Examples of suitable alkyl groups include, but are not necessarily limited to methyl groups, ethyl groups, propyl groups, isopropyl groups, butyl groups, isobutyl groups, secondary butyl groups, tertiary butyl groups, pentyl groups, isopentyl groups, secondary pentyl groups, neopentyl groups, tertiary pentyl groups, hexyl groups, secondary hexyl groups, heptyl groups, secondary heptyl groups, octyl groups, 2-ethylhexyl groups, secondary octyl groups, nonyl groups, secondary nonyl groups, decyl groups, secondary decyl groups, undecyl groups, secondary undecyl groups, dodecyl groups, secondary dodecyl groups, tridecyl groups, isotridecyl groups, secondary tridecyl groups, tetradecyl groups, secondary tetradecyl groups, hexadecyl groups, secondary hexadecyl groups, stearyl groups, icosyl groups, docosyl groups, tetracosyl groups, triacontyl groups, 2-butyloctyl groups, 2-butyldecyl groups, 2-hexyloctyl groups, 2-hexyldecyl groups, 2-octyldecyl groups, 2-hexyldodecyl groups, 2-octyldodecyl groups, 2-decyltetradecyl groups, 2-dodecylhexadecyl groups, 2-hexadecyloctadecyl groups, 2-tetradecyloctadecyl groups, monomethyl branched isostearyl groups and the like.

Examples of suitable alkenyl groups include, but are not necessarily limited to vinyl groups, allyl groups, propenyl groups, butenyl groups, isobutenyl groups, pentenyl groups, isopentenyl groups, hexenyl groups, heptenyl groups, octenyl groups, nonenyl groups, decenyl groups, undecenyl groups, dodecenyl groups, tetradecenyl groups, and oleyl groups.

Examples of suitable aryl groups include, but are not necessarily limited to phenyl groups, toluyl groups, xylyl groups, cumenyl groups, mesityl groups, benzyl groups, phenetyl groups, styryl groups, cynnamyl groups, benzhydryl groups, trityl groups, ethylphenyl groups, propylphenyl groups, butylphenyl groups, pentylphenyl groups, hexylphenyl groups, heptylphenyl groups, octylphenyl groups, nonylphenyl groups, decylphenyl groups, undecylphenyl groups, dodecylphenyl groups, phenylphenyl groups, benzylphenyl groups, styrenated phenyl groups, p-cumylphenyl groups, α-naphthyl, and β-naphthyl groups.

Examples of suitable cycloalkyl groups and cycloalkenyl groups include, but are not necessarily limited to cyclopentyl groups, cyclohexyl groups, cycloheptyl groups, methylcyclopentyl groups, methylcyclohexyl groups, methylcycloheptyl groups, cyclopentenyl groups, cyclohexenyl groups, cycloheptenyl groups, methylcyclopentenyl groups, methylcyclohexenyl groups, and methylcycloheptenyl groups.

Most preferred oil-soluble molybdenum compounds include, but are not necessarily limited to mononuclear dithiocarbamates having the following general structure:

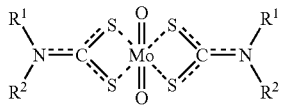

and di-nuclear dithiocarbamates having the following general structure:

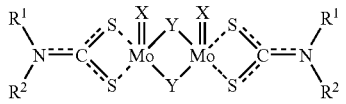

wherein $R^1$ and $R^2$ are as described above and X and Y are selected from the group consisting of sulfur and oxygen. Preferred commercially available friction modifiers include, but are not necessarily limited to NAUGALUBE MOLYFM 2543™, a mononuclear molybdenum dithiocarbamate available from Crompton Corporation.

In another embodiment, the molybdenum compound is a reaction product of a molybdenum compound having at least one pentavalent or hexavalent molybdenum atom with an amine having the formula $R^5$—NH—$R^6$ wherein $R^5$ to $R^6$ independently are selected from the group consisting of hydrogen and alkyl groups having from about 6 to 18 carbon atoms, provided that, when $R^5$ is a hydrogen atom, $R^6$ is an alkyl group.

In a preferred embodiment, $R^1$ to $R^6$ independently are selected from the group consisting of alkyl groups, alkenyl groups, and aryl groups. More preferably, $R^1$ and $R^2$ independently are selected from the group consisting of alkyl groups having from 8 to 13 carbon atoms; $R^3$ and $R^4$ independently are selected from the group consisting of alkyl groups having from 6 to 13 carbon atoms.

Preferred molybdenum oxysulfide compounds have the following general structure:

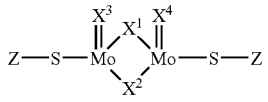

wherein $X^1$-$X^4$ independently are selected from the group consisting of a sulfur atom and an oxygen atom and Z is as described above.

Anti-Wear Component

Racing oils preferably are balanced to provide a combination of the molybdenum compounds, preferably molybdenum dithiocarbamates, and a substantial quantity of anti-wear component comprising zinc.

Zinc compounds have been associated with hindering the effectiveness of molybdenum containing friction modifiers in friction reducing lubricating oils. However, a combination of the molybdenum dithiocarbamates and anti-wear component comprising zinc surprisingly has demonstrated improved anti-friction and anti-wear properties than would be expected given the level of zinc in the racing oil.

Preferred anti-wear components are selected from the group consisting of zinc dihydrocarbyl dithiophosphates and zinc dihydrocarbyl dithiocarbamates. Preferred anti-wear components are zinc dihydrocarbyl dithiophosphates.

Preferred zinc dihydrocarbyl dithiophosphates are represented by the following formula:

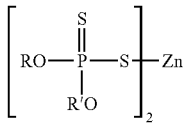

wherein R and R' are the same or different secondary hydrocarbyl radicals having from 1 to 18, preferably from 2 to 12 carbon atoms, including but not necessarily limited to alkyl groups, alkenyl groups, aryl groups, arylalkyl groups, alkaryl groups, and cycloaliphatic groups. Particularly preferred as R and R' groups are alkyl groups having from about 2 to about 8 carbon atoms, including but not necessarily limited to ethyl groups, i-propyl groups, sec-butyl groups, cyclohexyl groups, methylcyclopentyl groups, and combinations thereof. In order to obtain oil solubility, one or more of R or R' preferably comprises 5 or more carbon atoms. In a preferred embodiment, R is an alkyl group having 3 carbon atoms and R' is an alkyl group having 6 carbon atoms. Although secondary hydrocarbyl radicals are preferred, some primary hydrocarbyls may be present.

The amount of anti-wear component suitably is from about 1 to about 2.5 wt. %, preferably about 1.81 wt. %, based on the total weight of the racing oil. The amount of anti-wear component preferably produces a concentration of zinc in the racing oil of about 1400 or more, preferably 1500 or more, more preferably about 2000 or more, up to about 2600 ppm, as measured by X-ray fluorescence.

Where the anti-wear component is a zinc dihydrocarbyl dithiophosphate, the concentration of phosphorus in the racing oil suitably is about 1200 ppm or more, preferably about 1300 or more, more preferably at about 1800 ppm or more, up to about 2300 ppm, as measured by X-ray fluorescence.

Dihydrocarbyl dithiophosphate metal salts are commercially available, and may be prepared, for example, by reacting one or more alcohol or a phenol with $P_2S_5$ and then neutralizing with a metal compound. The alcohol may comprise a mixture of primary and secondary alcohols. Alternately, the $P_2S_5$ is reacted with an alcohol which is either secondary or primary in character. The metal salt generally is formed using a basic or neutral metal compound, typically one or more metal oxides, metal hydroxides and/or metal carbonates.

Dispersant

Dispersants maintain oil insoluble oxidation byproducts in solution. Dispersants generally may be ashless or ash-forming in nature, preferred dispersants being ashless dispersants. Ashless dispersants are organic materials that form substantially no ash upon combustion. For example, non-metal-containing or borated metal-free dispersants are considered ashless.

Preferred dispersants are selected from the group consisting of "modified" and unmodified "succinic compounds." Succinic compounds generally refer to butanedioic acid wherein the butane group and one or more of the carboxylic groups are unsubstituted or substituted.

Examples of suitable "succinic compounds" include, but are not necessarily limited to hydrocarbyl substituted succinic compounds, polyalkylpolyamine substituted succinic compounds, and combinations thereof. Preferred "succinic compounds" include but are not necessarily limited to succinimides, succinate esters, and/or succinate ester amides.

Preferred dispersants comprise succinimides. Preferred succinimides are bissuccinimides, most preferably unsubstituted bissuccinimides. Suitable succinimides are commercially available from Afton Chemical Corporation under the name HiTEC. In a preferred embodiment, the racing oil comprises about 4 wt. % unmodified bissuccinimide, based on the total weight of the racing oil.

Suitable hydrocarbyl groups confer solubility in the base oil. The hydrocarbyl groups generally comprise about 50 carbon atoms or more, suitably from about 50 to about 400 carbon atoms. Preferred hydrocarbyl groups are polyisobutylene groups.

Preferred polyalkylamine/polyalkypolyamine groups comprise the following moiety:

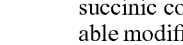

$$H_2N—(R—NH)_n—RNH_2$$

wherein n is from 0 to about 6; and, R is an alkyl group having from about 2 to about 3 carbon atoms, preferably 2 carbon atoms.

In order to produce "modified" succinic compounds, the succinic compounds are treated with various reagents. Suitable modification agents include, but are not necessarily limited to sulfur, oxygen, formaldehyde, carboxylic acids, hydrocarbyl dibasic acids or anhydrides, and boron compounds. Preferred modification agents comprise boron. Preferred modified succinic compounds comprise from about 0.1 to about 5 moles of boron per mole, based on the total weight of the modified succinic acid compound.

In a preferred embodiment, the dispersant is unmodified succinimide compound and hydrocarbyl substituted succinimide comprising polyisobutylene as the polymer backbone and incorporating polyalkylpolyamine. The polymer backbone preferably has a number average molecular weight of 700 or more up to about 2100, preferably about 950. Such preferred succinimide compounds are commercially available from a variety of sources, including but not necessarily limited to The Lubrizol Corporation, Infineum, and Afton Chemical Corporation. A preferred succinimide is HiTEC 644, commercially available from Afton Chemical Corporation. Where the dispersant is modified succinimide, the molecular weight of the succinimide may be higher, suitably up to about 2500 number average molecular weight.

The racing oil suitably comprises a sufficient quantity of the dispersant to contribute a nitrogen concentration of about 200 ppm or more, preferably 500 ppm or more, more preferably 900 ppm or more, suitably up to about 2800 ppm, preferably up to about 1500 ppm, more preferably up to about 1000 ppm, based on the nitrogen content of the component and the amount of the component used. The nitrogen concentration also may be measured by ASTM D 5762-02.

Detergent

The racing oil also generally comprises one or more detergent, typically a metal salt of an organic acid, more preferably a calcium salt of a substituted salicylic acid.

The metal detergent minimizes varnish, ring zone deposits, and rust by solubilizing oil insoluble particles. Overbased detergents help neutralize acids that accumulate in lubricating oil during use.

Typical detergents comprise an organic anion having an oleophilic portion and a smaller ionic or oleophobic portion. Suitable detergents comprise organic anions selected from the group consisting of sulfonates, phenates, and salicylates. Preferred anions are salicylates.

The cation typically is a metal cation selected from the group consisting of alkali metals and alkaline earth metals having a valence of +2. Suitable metals include, but are not necessarily limited to alkaline earth metals selected from Group II of the Periodic Table of the Elements. When the Periodic Table of the Elements is referred to herein, the source of the Periodic Table is: F. Cotton et al. *Advanced Inorganic Chemistry* (5th Ed. 1988). Suitable alkaline earth metals include, but are not necessarily limited to Be, Mg, Ca, Sr, Ba, and Ra. More suitable metals include, but are not necessarily limited to calcium, magnesium, and combinations thereof. Most preferably, the metal is calcium. Most preferred metal detergents are calcium salicylates.

Salts that contain a substantially stoichiometric amount of the metal are described as neutral salts and have from about 0 to about 80 total base number [TBN, or mg KOH/g; measured by ASTM D 2896]. The detergent preferably is overbased, having a TBN of 150 or higher, preferably about 168, up to about 450 or more. Salicylate detergents may be prepared by reacting a basic metal compound with at least one salicylic acid compound and removing free water from the reaction product.

Hydrocarbyl-substituted salicylic acids may be prepared from phenols by the Kolbe reaction. See U.S. Pat. No. 3,595,791, incorporated herein by reference. The metal salts of the hydrocarbyl-substituted salicylic acids may be prepared by double decomposition of a metal salt in a polar solvent such as water or alcohol. See U.S. Patent Application No. 2003/0191032 A1, incorporated herein by reference, and U.S. Pat. No. 6,852,679, incorporated herein by reference. Preferred calcium salicylates are available from Infineum, with currently available products including M7101 and M7121.

The racing oils comprise an amount of detergent which results in a concentration of metal, preferably calcium, of from about 550 ppm to about 2500 ppm, preferably about 900 ppm, as measured by X-ray fluorescence. In a preferred embodiment, the racing oil comprises about 1.5 wt. % calcium salicylate detergent, based on the total weight of the racing oil.

Antioxidant

The racing oil also preferably comprises antioxidant. Antioxidants retard the oxidative degradation of base oils during service. Such degradation may result in deposits on metal surfaces, the presence of sludge, or a viscosity increase in the lubricant. A wide variety of oxidation inhibitors are useful in conventional lubricating oil compositions, and in the racing oil compositions. See, e.g., U.S. Pat. Nos. 4,798,684; 5,084,197; 6,599,865, incorporated herein by reference.

Suitable antioxidants include, but are not necessarily limited to aminic and/or phenolic antioxidants. Preferred antioxidants are mixed aminic/phenolic antioxidants, suitably comprising about 6 wt. % phenolic and 94 wt. % aminic antioxidant, preferably comprising about 80 wt % aminic and about 20 wt. % phenolic material, based on the total weight of the antioxidant.

A variety of phenolic compounds are suitable as phenolic antioxidants, including but not necessarily limited to alkylphenols and bisphenols. Preferred phenols are hindered phenols.

Suitable hindered phenols are represented by the generic formula below in which $R^1$ and $R^2$ are the same or different alkyl groups having from about 3 to about 9 carbon atoms; $R^3$ is selected from the group consisting of alkyl groups having from about 7 to about 9 carbon atoms; x and y are integers from 1 to 4; n is an integer from 1 to 4, and X is selected from the group consisting of carbon and sulfur:

1)

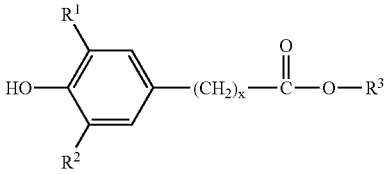

2)

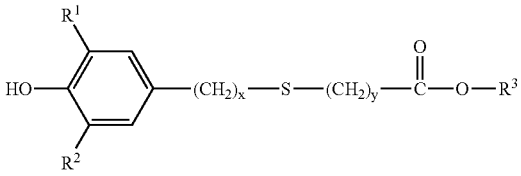

3)

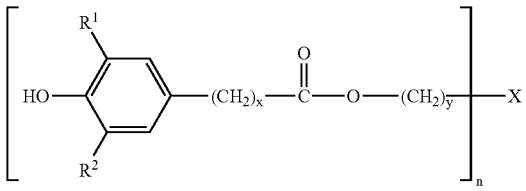

Preferred antioxidants are hydrocinnamate esters of propionic acid, most preferably butylated hydrocinnamates. Preferred antioxidants have the general formula (3) wherein $R^1$ and $R^2$ are t-butyl groups; n is an integer from 1 to 4; X is sulfur; and, Y is 2.

Suitable aminic antioxidants include, but are not necessarily limited to diaryl amines, aryl naphthyl amines, and alkyl derivatives of diaryl amines and aryl naphthyl amines. Examples of aminic antioxidants are represented by the formulas below, wherein each of $R^4$ and $R^5$ is a hydrogen atom or represents the same or different alkyl groups having from 1 to 9 carbon atoms.

1)

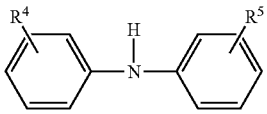

2)

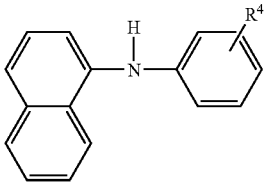

Preferred aminic antioxidants have the general formula (1) wherein $R^4$ and $R^5$ are selected from the group consisting of alkyl groups having from about 1 to about 9 carbon atoms, more suitably from about 4 to about 9 carbon atoms.

Specific examples of the aminic antioxidants include, but are not necessarily limited to: monoalkyldiphenyl amines; dialkyldiphenyl amines; polyalkyldiphenyl amines; naphthylamines, including but not necessarily limited to phenyl-α-naphthylamines and alkyl substituted versions thereof having from about 1 to about 9 carbon atoms, preferably from about 4 to about 9 carbon atoms. Examples include, but are not necessarily limited to: monooctyldiphenyl amine; monononyl diphenyl amine; 4,4'-dibutyldiphenyl amine; 4,4'-dipentyldiphenyl amine; 4,4'-dihexyldiphenyl amine; 4,4'-diheptyldiphenyl amine, 4,4'-dioctyldiphenyl amine; 4,4'-dinonyldiphenyl amine; tetra-butyldiphenyl amine; tetra-hexyldiphenyl amine; tetra-octyldiphenyl amine; tetra-nonyldiphenyl amine; α-naphthylamine; phenyl-α-naphthylamine; butylphenyl-α-naphthylamine; pentylphenyl-α-naphthylamine; hexylphenyl-α-naphthylamine; heptylphenyl-α-naphthylamine, octylphenyl-α-naphthylamine; and nonylphenyl-α-naphthylamine.

Preferred aminic antioxidants are selected from the group consisting of dialkyldiphenyl amines, naphthylamines, and combinations thereof.

The racing oil preferably comprises from about 0.5 to about 2 wt. % antioxidant, preferably about 1 wt. % or more antioxidant, more preferably about 1 wt % anti-oxidant, based on the total weight of the racing oil.

Anti-Foaming Agent

In a preferred embodiment, the racing oil comprises one or more anti-foaming agent. Substantially any conventional antifoaming agent may be used. Examples of suitable anti-foaming agents include but are not necessarily limited to polydimethylsiloxanes, trifluoropropylmethylsilicones, colloidal silicas, polyalkylacrylates, polyalkylmethacrylates, alcoholethoxy/propoxylates, fatty acid ethoxy/propoxylates, sorbitan partial fatty acid esters, and combinations thereof.

Preferred anti-foaming agents are polydimethyl siloxanes. The anti-foaming agent preferably is diluted or "cut back" to about 10 vol. % polydimethylsiloxane, based on the total volume of the anti-foaming agent, using a suitable solvent, including but not necessarily limited to mineral spirits or No. 1 diesel fuel. Suitable standard polydimethylsiloxane anti-foaming agents are commercially available from a number of sources, including but not necessarily limited to Dow Corning (DOW CORNING 200 FLUID) and General Electric (VISCASIL).

The amount of antifoaming agent in the racing oil generally is from about 8 ppm to about 25 ppm, preferably about 10 ppm to about 24 ppm, more preferably from about 10 ppm to about 20 ppm. Where the anti-foaming agent is polydimethylsiloxane "cut back" to about 10 vol. %, the amount of anti-foaming agent in the racing oil generally is about 0.02 wt. %, based on the total weight of the racing oil.

Viscosity Index Improver

The racing oil may or may not comprise a viscosity index improver (VII). A variety of viscosity index improvers are commercially available. Preferred viscosity index improvers, if used, are star polymer (isoprene copolymer) viscosity index improvers. A suitable VII is SV200 Blend, available from Infineum as SV205. The use of the phrase "consisting essentially of" in the claims does not preclude the use of a viscosity index improver in the racing oil.

Other Additives

Preferably, the racing oil does not contain unnecessary additives. For example, it is not a requirement for the racing oil to contain added rust inhibitor. However, the racing oil may contain traditional lubricant additives which do not interfere with the high performance requirements of the racing oil.

Blending

The components may be incorporated into the base stock in any convenient way in any convenient order. Typically, the base oil is provided first and the ester and other racing oil components are added. In one embodiment, the components are mixed with the ester to produce an additive/ester solution which is then mixed with the PAO. Blending may occur at ambient temperature or at an elevated temperature.

The following Table lists the products used in the following examples:

| Product | Description |
|---|---|
| DURASYN 162 | 2 cSt polyalphaolefin (PAO), commercially available from BP Chemical |
| DURASYN 164 | 4 cSt PAO, commercially available from BP Chemical |
| DURASYN 166 | 6 cSt PAO, commercially available from BP Chemical |
| DURASYN 170 | 10 cSt PAO, commercially available from BP Chemical |
| SPECTRASYN 40 | 40 cSt PAO, commercially available from Exxon Mobil Chemical |
| PRIOLUBE 3970 | multiester, commercially available from UNIQEMA |
| EMEREST 2421 (AGNIQUE GMO-U) | glycerol monooleate, commercially available from Cognis |
| EMERY 2913-U | isodecyl/tridecyl trimellitate - ester basestock, commercially available from Cognis |
| IRGANOX L 64 | mixed 80% aminic & 20% phenolic antioxidant, commercially available from Ciba Specialty Chemicals |
| NAUGALUBE MOLY FM 2543 | friction modifier comprising mixed thio acid amide molybdenum complexes, commercially available from Crompton Corporation |
| HiTEC 312 | sulfurized isobutylene extreme pressure additive, commercially available from Afton Chemical Corporation. |
| HiTEC 644 | succinimide (950 MW) dispersant, commercially available from Afton Chemical Corporation. |
| INFINEUM M7101 | calcium salicylate detergent, commercially available from Infineum. |
| SV205 | star polymer (isoprene copolymer) viscosity index improver, available from Infineum |
| LUBRIZOL 1371 | C3, C6 secondary ZDTP anti-wear additive, commercially available from Lubrizol |
| DOW CORNING 200 FLUID | polydimethylsiloxane antifoam additive (cutback), commercially available from Dow Corning. |

The application will be better understood with reference to the Examples, which are illustrative only and should not be construed as limiting the claims:

Materials and Methods

The following Materials and Methods were used to in the following Examples.

Standardized Test Methods

The test methods used to measure the various parameters of the racing oils were:

| Test | Method |
|---|---|
| Kinematic Viscosity @ 40° C., cSt | ASTM D 445 |
| Kinematic Viscosity @ 100° C., cSt | ASTM D 445 |
| Viscosity Index | ASTM D 2270 |
| HTHS Viscosity @ 150° C., cP | ASTM D 4683 |
| Low-Temp Cranking Visc. @ −15° C., cP | ASTM D 5293 |
| Low-Temp Cranking Visc. @ −20° C., cP | ASTM D 5293 |
| Low-Temp Cranking Visc. @ −25° C., cP | ASTM D 5293 |
| Low-Temp Cranking Visc. @ −30° C., cP | ASTM D 5293 |
| Low-Temp Cranking Visc. @ −35° C., cP | ASTM D 5293 |
| Shear Stability, 30 Passes | ASTM D 6278 |
| Viscosity @ 100° C., New, cSt | |
| Viscosity @ 100° C., Sheared, cSt | |
| Viscosity Loss, % | |

Nitrogen

Nitrogen concentration was calculated based on the nitrogen concentration of the component and the amount of the component used. The nitrogen concentration also may be measured according to ASTM D 5762-02.

X-Ray Fluorescence

The concentration of various elements in the racing oil was determined by X-ray fluorescence using a Philips PW2400 Sequential Wavelength Dispersive X-Ray Fluorescence (WDXRF) Spectrometer. The spectrometer was equipped with SUPERQ Version 3.0 software (or comparable); a glass disc instrument monitor, commercially available from Brammer Standards Inc.; and, a balance equipped to measure to 4 decimal places.

The spectrometer was calibrated using commercially available standards for the elements to be tested, preferably a 32 standard set. Instrument monitors ran concurrent with the calibration standards. Using one or several standards, a scan was run to locate the peak angle and an appropriate background point. The difference in the peak and background was the net intensity used for all measurements. Also, from this scan the pulse height distribution was checked. Based on the peak to background ratio, the measurement time was calculated using the instrument software. The monitor and standards were run on the program using the conditions above and the measuring times determined. The standards produced a linear calibration with the slope and intercept determined in the software.

Approximately 4 ml of a given racing oil sample was pipetted into a 31 mm polypropylene X-ray sample cell, which was obtained from VHG Labs. The sample was placed in an X-ray cup for liquid cells and loaded into the WDXRF Spectrometer for measurement. The WDXRF operating conditions were within the manufacturer's specifications, including cooling water and gas flows. The measuring atmosphere was helium.

The result was calculated using the slope and intercept of the calibration line where net intensity was plotted versus the concentration. The detection limits were calculated as three times the standard deviation of a least squares fit of the calibration standards. The standard error was reported as the greater of two times the standard deviation of the calibration curve or two times the confidence limit of the QA as calculated in the NWA Quality software program. Results can be reported in weight percent or ppm, whichever is more convenient.

A HAVOLINE 5W-30 with a CL additive was prepared. Ten replicates were performed on the material by two different analysts over a one month period. The elements included in the sample were those typically found in fresh blends of the typical lubricant. See results below (all % wt.)

| | |
|---|---|
| Ca | 0.126 +/− 0.002 |
| Cl | 0.094 +/− 0.002 |
| Mg | 0.059 +/− 0.003 |
| P | 0.092 +/− 0.002 |
| S | 0.44 +/− 0.01 |
| Zn | 0.114 +/− 0.001 |

The sample was run each time racing oil samples were analyzed (maximum of once per day). The sample was believed stable over time and was sent to various lube blending terminals for analysis to support quality control for all blending locations.

The accuracy of the measurements was tested using standards, including TARM (Texaco Analytical Reference Materials) and PIQS (Product Insurance Quality Standards) samples acquired from Texaco. The values were established through multiple analysis using XRF, ICP, and/or gravimetric analysis. The following were recorded:

| ID | Ca exp | Ca mea | P exp | P mea | Cu exp | Cu mea | S exp | S mea | Zn exp | Zn mea |
|---|---|---|---|---|---|---|---|---|---|---|
| Tarm7 | .218 | .215 | .130 | .126 | .014 | .014 | 0.61 | 0.61 | .146 | .142 |
| Tarm8 | .178 | .178 | .115 | .115 | .013 | .012 | 0.58 | 0.59 | .129 | .128 |
| Tarm18 | .006 | .006 | .025 | .026 | | | 0.50 | 0.55 | .029 | .031 |
| 1854 | .0033 | .0033 | .022 | .023 | | | na | 0.08 | 2 ppm | 1 ppm |
| 2109 | .296 | .294 | .117 | .118 | | | na | 0.48 | .129 | .131 |
| 1659 | .0064 | .0066 | .025 | .025 | | | na | 0.06 | .030 | .032 |

Results were reported in weight percent or ppm for a number of elements, including but not necessarily limited to molybdenum, zinc, calcium, phosphorus, and nitrogen.

See also ASTM D 4927-96, Standard Test Methods for Elemental Analysis of Lubricant and Additive Components—Barium, Calcium, Phosphorous, Sulfur, and Zinc by Wavelength-Dispersive X-ray Fluorescence Spectroscopy, incorporated herein by reference.

Friction Coefficient

The friction coefficient produced using the racing oils was determined using a High Frequency Reciprocating Rig (HFRR). The HFRR used an electromagnetic vibrator to oscillate a moving specimen over a small amplitude while pressing it against a fixed specimen. The moving specimen was a 6 mm AISI E-52100 steel ball, Vickers hardness (Hv) 800. The fixed specimen was an AISI E-52100 steel flat, Hv 30. The combination of a hard ball sliding on a soft flat provided acceptable discrimination between good and poor diesel fuels.

The method used was a variant of ASTM D 6079, a HFRR test method used to evaluate diesel fuel lubricity, in which a series of temperature steps at higher temperatures was used in place of a fixed temperature. The wear scar was measured on the ball. The scar diameter measurements made on the ball were an indirect measure of wear that occurred on the flat. The coefficient of friction μ between the specimens is given by:

$$\mu = \frac{F}{P}$$

Where F is the friction force and P is the applied load in Newtons. Boundary film formation and the effects of certain friction modifiers occur at high temperatures. Film formation by boundary additives can be observed by electrical contact potential changes. A low or zero film reading means that the potential drop across the contact is low, indicating significant metal to metal contact taking place between the specimens. This is usually associated with high friction force and high wear. A high film reading meant that the metal surfaces were being separated. This may have been by a chemical film formed by additives.

HFRR test conditions were as follows:

400 g load (Hertzian contact pressure 1005 Mpa)

1000 μm stroke 80-180° C.

20° C. intervals, 5 minutes per interval

Friction coefficient and contact film resistance were measured at five second intervals and were averaged at the end of each five minute interval. Wear scars were measured at the completion of the test. Measurements in the x- and y-directions were averaged. Although the initial Hertzian contact pressure was very high (1005 Mpa), as the wear increased the contact pressures reduced to less than 100 Mpa.

Anti Foaming

Antifoaming was measured using a Standard Waring Blender. In order to remove excess lubricant from the glassware to be used, the container of a Waring Blender and the other glassware were rinsed with kerosene or petroleum naphtha followed by a hot soapy water wash, hot water rinse, acetone rinse and blow-drying.

A 200 ml charge of the test lubricant was warmed to 37.78° C. (150° F.) and placed in the Waring Blender. The cover was placed on the container and the charge was blended at high speed (18,000 rpm) for exactly 30 seconds. The blender was switched off, the cover removed, and the container contents poured into a 600-ml beaker, allowing the container to drain for 10 seconds. The beaker was set aside where it could be observed undisturbed. The relative stability of the foams was estimated by comparing the time required for the foam layer on the test samples to collapse. The foam collapse time was the elapsed time required in minutes for the foam layer to disperse sufficiently for about one square inch of foam-free liquid surface to be observed. Other visual observations were recorded as needed, such as foam appearance, initial thickness of foam layer, estimated air release rate, and the like.

The application will be better understood with reference to the following examples, which are illustrative only:

EXAMPLE 1

The racing oil formulations in the following Tables were prepared:

0W5:

| | GRADE | | | | |
|---|---|---|---|---|---|
| Component (wt %) | 0W5 (A) | 0W5 (B) | 0W5 (C) | 0W5 (D) | 0W5 (E) |
| PAO 2 cSt | 27.84 | 27.84 | 28.20 | 29.16 | 31.22 |
| PAO 4 cSt | 51.19 | 51.19 | 50.83 | 49.07 | 47.10 |
| Diester | 10.00 | 10.00 | 10.00 | 10.00 | 10.00 |
| Succinimide dispersant | 4.00 | 4.00 | 4.00 | 4.00 | 4.00 |
| Calcium salicylate detergent | 1.50 | 1.50 | 1.50 | 1.50 | 1.50 |
| C3, C6 secondary ZDTP anti-wear component | 1.10 | 1.10 | 1.10 | 1.90 | 1.81 |

-continued

| Component (wt %) | GRADE 0W5 (A) | 0W5 (B) | 0W5 (C) | 0W5 (D) | 0W5 (E) |
|---|---|---|---|---|---|
| 80% aminic/20% phenolic antioxidant | 1.00 | 1.00 | 1.00 | 1.00 | 1.00 |
| polyol monoester | 0.80 | 0.80 | 0.80 | 0.80 | 0.80 |
| friction modifier (Mo) | 1.80 | 1.80 | 1.80 | 1.80 | 1.80 |
| sulfurized isobutylene EP additive | 0.75 | 0.75 | 0.75 | 0.75 | 0.75 |

-continued

| Component (wt %) | GRADE 0W5 (A) | 0W5 (B) | 0W5 (C) | 0W5 (D) | 0W5 (E) |
|---|---|---|---|---|---|
| Antifoaming Agent (cut back) | 0.02 | 0.02 | 0.02 | 0.02 | 0.02 |
| Total | 100.00 | 100.00 | 100.00 | 100.00 | 100.00 |

0W20:

| Component (wt %) | GRADE 0W20 (A) | 0W20 (B) | 0W20 (C) | 0W20 (D) | 0W20 (E) | 0W20 (F) | 0W20 (G) | 0W20 (H) | 0W20 (I) |
|---|---|---|---|---|---|---|---|---|---|
| PAO 4 cSt | 0.92 | 0.92 | 0.92 | 7.94 | 5.98 | 5.93 | 5.84 | 4.37 | 4.44 |
| PAO 6 cSt | 78.86 | 78.86 | 78.86 | 71.04 | 73.09 | 73.14 | 73.23 | 74.70 | 74.63 |
| Diester | 10.00 | 10.00 | 10.00 | 10.00 | 10.00 | 10.00 | 10.00 | 10.00 | 10.00 |
| Succinimide dispersant | 4.00 | 4.00 | 4.00 | 4.00 | 4.00 | 4.00 | 4.00 | 4.00 | 4.00 |
| Calcium salicylate detergent | 1.50 | 1.50 | 1.50 | 1.50 | 1.50 | 1.50 | 1.50 | 1.50 | 1.50 |
| C3, C6 secondary ZDTP anti-wear component | 1.10 | 1.10 | 1.10 | 1.90 | 1.81 | 1.81 | 1.81 | 1.81 | 1.81 |
| 80% aminic/20% phenolic antioxidant | 1.00 | 1.00 | 1.00 | 1.00 | 1.00 | 1.00 | 1.00 | 1.00 | 1.00 |
| polyol monoester | 0.80 | 0.80 | 0.80 | 0.80 | 0.80 | 0.80 | 0.80 | 0.80 | 0.80 |
| friction modifier (Mo) | 1.80 | 1.80 | 1.80 | 1.80 | 1.80 | 1.80 | 1.80 | 1.80 | 1.80 |
| Antifoaming Agent (cut back) | 0.02 | 0.02 | 0.02 | 0.02 | 0.02 | 0.02 | 0.02 | 0.02 | 0.02 |
| Total | 100.00 | 100.00 | 100.00 | 100.00 | 100.00 | 100.00 | 100.00 | 100.00 | 100.00 |

17.5W35:

| Component (wt %) | GRADE 17.5W35 (A) | 17.5W35 (B) | 17.5W35 (C) | 17.5W35 (D) | 17.5W35 (E) |
|---|---|---|---|---|---|
| PAO 10 cSt | 61.71 | 62.54 | 65.88 | 65.30 | 60.18 |
| PAO 25 cSt | — | — | — | — | 13.19 |
| PAO 40 cSt | 12.37 | 11.54 | 7.40 | 8.07 | — |
| Aromatic multiester | 15.00 | 15.00 | 15.00 | 15.00 | 15.00 |
| Succinimide dispersant | 4.00 | 4.00 | 4.00 | 4.00 | 4.00 |
| Calcium salicylate detergent | 1.50 | 1.50 | 1.50 | 1.50 | 1.50 |
| C3, C6 secondary ZDTP anti-wear component | 1.10 | 1.10 | 1.90 | 1.81 | 1.81 |
| 80% aminic/20% phenolic antioxidant | 1.00 | 1.00 | 1.00 | 1.00 | 1.00 |
| polyol monoester | 1.50 | 1.50 | 1.50 | 1.50 | 1.50 |
| friction modifier (Mo) | 1.80 | 1.80 | 1.80 | 1.80 | 1.80 |
| Antifoaming Agent (cut back) | 0.02 | 0.02 | 0.02 | 0.02 | 0.02 |
| Total | 100.00 | 100.00 | 100.00 | 100.00 | 100.00 |

7.5W35:

| Component (wt %) | GRADE 7.5W35 (A) | 7.5W35 (B) | 7.5W35 (C) | 7.5W35 (D) | 7.5W35 (E) | 7.5W35 (F) |
|---|---|---|---|---|---|---|
| PAO 6 cSt | 39.10 | 44.31 | 46.40 | 54.04 | 52.92 | 52.94 |
| PAO 10 cSt | 29.62 | 24.22 | 21.63 | 13.73 | 14.95 | 14.93 |
| Aromatic multiester | 15.00 | 15.00 | 15.00 | 15.00 | 15.00 | 15.00 |
| Succinimide dispersant | 4.00 | 4.00 | 4.00 | 4.00 | 4.00 | 4.00 |

-continued

| Component (wt %) | GRADE 7.5W35 (A) | 7.5W35 (B) | 7.5W35 (C) | 7.5W35 (D) | 7.5W35 (E) | 7.5W35 (F) |
|---|---|---|---|---|---|---|
| Calcium salicylate detergent | 1.50 | 1.50 | 1.50 | 1.50 | 1.50 | 1.50 |
| C3, C6 secondary ZDTP anti-wear component | 1.10 | 1.90 | 1.90 | 1.81 | 1.81 | 1.81 |
| 80% aminic/20% phenolic antioxidant | 1.00 | 1.00 | 1.00 | 1.00 | 1.00 | 1.00 |
| polyol monoester | 1.50 | 1.50 | 1.50 | 1.50 | 1.50 | 1.50 |
| friction modifier (Mo) | 1.80 | 1.80 | 1.80 | 1.80 | 1.80 | 1.80 |
| Isoprene copolymer (VI improver) | 5.36 | 4.75 | 5.25 | 5.60 | 5.50 | 5.50 |
| Antifoaming Agent (cut back) | 0.02 | 0.02 | 0.02 | 0.02 | 0.02 | 0.02 |
| Total | 100.00 | 100.00 | 100.00 | 100.00 | 100.00 | 100.00 |

15W50:

| Component (wt %) | GRADE 15W50 (A) | 15W50 (B) | 15W50 (C) | 15W50 (D) | 15W50 (E) | 15W50 (F) | 15W50 (G) | 15W50 (H) |
|---|---|---|---|---|---|---|---|---|
| PAO 10 cSt | 63.61 | 65.85 | 66.47 | 65.24 | 65.78 | 65.88 | 66.17 | 66.17 |
| PAO 40 cSt | — | — | — | 1.60 | — | — | — | — |
| PAO 100 cSt | 3.23 | 0.99 | — | — | — | — | — | — |
| Aromatic multiester | 15.00 | 15.00 | 15.00 | 15.00 | 15.00 | 15.00 | 15.00 | 15.00 |
| Succinimide dispersant | 4.00 | 4.00 | 4.00 | 4.00 | 4.00 | 4.00 | 4.00 | 4.00 |
| Calcium salicylate detergent | 1.50 | 1.50 | 1.50 | 1.50 | 1.50 | 1.50 | 1.50 | 1.50 |
| C3, C6 secondary ZDTP anti-wear component | 1.10 | 1.10 | 1.10 | 1.10 | 1.90 | 1.90 | 1.81 | 1.81 |
| 80% aminic/20% phenolic antioxidant | 1.00 | 1.00 | 1.00 | 1.00 | 1.00 | 1.00 | 1.00 | 1.00 |
| polyol monoester | 1.50 | 1.50 | 1.50 | 1.50 | 1.50 | 1.50 | 1.80 | 1.50 |
| friction modifier (Mo) | 1.80 | 1.80 | 1.80 | 1.80 | 1.80 | 1.80 | 1.50 | 1.80 |
| sulfurized isobutylene EP additive | 7.24 | 7.24 | 7.61 | 7.24 | 7.50 | 7.40 | 7.20 | 7.20 |
| Antifoaming Agent (cut back) | 0.02 | 0.02 | 0.02 | 0.02 | 0.02 | 0.02 | 0.02 | 0.02 |
| Total | 100.00 | 100.00 | 100.00 | 100.00 | 100.00 | 100.00 | 100.00 | 100.00 |

EXAMPLE 2

A variety of properties were measured for the formulations prepared in Example 1 including: kinematic viscosity, viscosity index, contact film, coefficient of friction, wear scar, foaming, gravity, and density properties. An elemental analysis of the formulations also was performed.

The results are given in the following Tables:

0W5 Properties:

| Test | Method | RACING OIL 0W5 (A) | 0W5 (B) | 0W5 (C) | 0W5 (D) | 0W5 (E) |
|---|---|---|---|---|---|---|
| Kinematic Viscosity @ 40° C., cSt | ASTM D 445 | 15.37 | 15.03 | 15.45 | 15.42 | 15.23 |
| Kinematic Viscosity @ 100° C., cSt | ASTM D 445 | 3.64 | 5.57 | 3.61 | 3.67 | 3.56 |
| Viscosity Index | ASTM D 2270 | 123 | 120 | 117 | 126 | 115 |
| HTHS Viscosity @ 150° C., Cp | ASTM D 4683 | 1.42 | 1.41 | — | — | 1.38 |
| Low-Temp Cranking Visc. @ −35° C., cP | ASTM D 5293 | 1,030 | 870 | 870 | — | 880 |
| Shear Stability, 30 Passes | ASTM D 6278 | | | | | |
| Viscosity @ 100° C., New, cSt | | 3.78 | — | — | — | — |
| Viscosity @ 100° C., Sheared, cSt | | 3.60 | — | — | — | — |
| Viscosity Loss, % | | 4.76 | — | — | — | — |
| Waring Blender Foam, 150° F. | In house | | | | | |
| Appearance, inches | | No Foam | — | — | — | No Foam |
| Break Time, min. | | 0.00 | — | — | — | 0.00 |
| API Gravity @ 15.56° C. (60° F.) | Calc. per ASTM D 287-92 | 36.9 | 37.0 | 37.0 | — | 36.5 |
| Density @ 15.56° C. (60° F.), g/cm3 | ASTM D 4052 | 0.8394 | 0.8391 | 0.8391 | — | 0.8415 |
| Specific Gravity @ 60/15.56° C. (60° F.) | ASTM D 4052 | 0.8403 | 0.8399 | 0.8399 | — | 0.8424 |
| HFRR | | | | | | |
| Avg. Contact Film 1% @ 80° C. | | 14.0 | — | — | — | 4.8 |

-continued

| Test | Method | RACING OIL 0W5 (A) | 0W5 (B) | 0W5 (C) | 0W5 (D) | 0W5 (E) |
|---|---|---|---|---|---|---|
| Avg. Contact Film 2% @ 100° C. | | 68.0 | — | — | — | 39.8 |
| Avg. Contact Film 3% @ 120° C. | | 43.9 | — | — | — | 47.6 |
| Avg. Contact Film 4% @ 140° C. | | 63.0 | — | — | — | 69.5 |
| Avg. Contact Film 5% @ 160° C. | | 82.7 | — | — | — | 79.4 |
| Avg. Contact Film 6% @ 180° C. | | 92.0 | — | — | — | 84.9 |
| Avg. Friction Coeff. 1% @ 80° C. | | 0.120 | — | — | — | 0.119 |
| Avg. Friction Coeff 2% @ 100° C. | | 0.119 | — | — | — | 0.101 |
| Avg. Friction Coeff. 3% @ 120° C. | | 0.100 | — | — | — | 0.074 |
| Avg. Friction Coeff. 4% @ 140° C. | | 0.066 | — | — | — | 0.069 |
| Avg. Friction Coeff. 5% @ 160° C. | | 0.060 | — | — | — | 0.060 |
| Avg. Friction Coeff. 6% @ 180° C. | | 0.059 | — | — | — | 0.061 |
| Avg. Wear Scar @ Load 400 g, Stroke 1000 μm, Time 5 min, μm | | 175 | — | — | — | 160 |

— indicates test not run

0W5 Elemental Analysis:

Elemental analysis of the foregoing racing oil formulations was performed as described in more detail above, yielding the following results:

| Test | Method | RACING OIL 0W5 (A) | 0W5 (B) | 0W5 (C) | 0W5 (E) |
|---|---|---|---|---|---|
| XRF Lubricant Elements | X-Ray Fluorescence | | | | |
| Calcium, ppm | | 860 | 980 | 860 | 850 |
| Chlorine, ppm | | <40 | <200 | <40 | <40 |
| Copper, ppm | | <20 | <100 | <20 | <20 |
| Iron, ppm | | <20 | <100 | <20 | <20 |

-continued

| Test | Method | RACING OIL 0W5 (A) | 0W5 (B) | 0W5 (C) | 0W5 (E) |
|---|---|---|---|---|---|
| Magnesium, ppm | | <40 | <200 | <40 | <40 |
| Molybdenum, ppm | | 660 | 740 | 660 | 770 |
| Phosphorus, ppm | | 1100 | 1160 | 1110 | 1810 |
| Potassium, ppm | | <80 | <400 | <80 | <80 |
| Silicon, ppm | | 30 | <200 | 40 | <40 |
| Sodium, ppm | | <100 | <500 | <100 | <100 |
| Sulfur, ppm | | 7160 | 7370 | 6930 | 8670 |
| Zinc, ppm | | 1230 | 1320 | 1240 | 2000 |

0W20 Properties:

| Test | Method | RACING OIL 0W20 (A) | 0W20 (B) | 0W20 (C) | 0W20 (D) | 0W20 (E) |
|---|---|---|---|---|---|---|
| Kinematic Viscosity @ 40° C., cSt | ASTM D 445 | 36.45 | 36.43 | 36.9 | 34.81 | 36.36 |
| Kinematic Viscosity @ 100° C., cSt | ASTM D 445 | 6.53 | 6.50 | 6.55 | 6.37 | 6.46 |
| Viscosity Index | ASTM D 2270 | 134 | 133 | 132 | 136 | 131 |
| HTHS Viscosity @ 150° C., cP | ASTM D 4683 | 2.24 | 2.17 | 2.28 | 2.28 | 2.24 |
| Low-Temp Cranking Visc. @ −35° C., cP | ASTM D 5293 | 5,690 | 5,760 | 5,660 | — | 5,720 |
| Shear Stability, 30 Passes | ASTM D 6278 | | | | | |
| Viscosity @ 100° C., New, cSt | | 6.59 | — | — | — | — |
| Viscosity @ 100° C., Sheared, cSt | | 6.50 | — | — | — | — |
| Viscosity loss, % | | 1.37 | | | | |
| Waring Blender Foam, 150° F. | | | | | | |
| Appearance, inches | | No Foam | — | — | — | — |
| Break Time, min. | | 0.00 | — | — | — | — |
| API Gravity @ 15.56° C. (60° F.) | | 34.7 | 34.2 | 34.7 | — | 34.3 |
| Density @ 15.56° C. (60° F.), g/cm3 | ASTM D 4052 | 0.8506 | 0.8529 | 0.8507 | — | 0.8526 |

-continued

| | | | | | | |
|---|---|---|---|---|---|---|
| Specific Gravity @ 60/15.56° C. (60° F.) | ASTM D 4052 | 0.8514 | 0.8538 | 0.8516 | — | 0.8534 |
| HFRR | | | | | | |
| Avg. Contact Film 1% @ 80° C. | | 5.1 | — | — | — | 9.0 |
| Avg. Contact Film 2% @ 100° C. | | 41.8 | — | — | — | 64.0 |
| Avg. Contact Film 3% @ 120° C. | | 69.6 | — | — | — | 70.0 |
| Avg. Contact Film 4% @ 140° C. | | 67.7 | — | — | — | 80.0 |
| Avg. Contact Film 5% @ 160° C. | | 94.1 | — | — | — | 77.0 |
| Avg. Contact Film 6% @ 180° C. | | 95.5 | — | — | — | 72.2 |
| Avg. Friction Coeff. 1% @ 80° C. | | 0.118 | — | — | — | 0.114 |
| Avg. Friction Coeff. 2 % @ 120° C. | | 0.117 | — | — | — | 0.097 |
| Avg. Friction Coeff. 3 % @ 140° C. | | 0.115 | — | — | — | 0.057 |
| Avg. Friction Coeff. 4 % @ 160° C. | | 0.072 | — | — | — | 0.052 |
| Avg. Friction Coeff. 5 % @ 180° C. | | 0.051 | — | — | — | 0.054 |
| Avg.Friction Coeff. 6 @ 180° C. | | 0.053 | — | — | — | 0.059 |
| Avg. Wear Scar @ Load 400 g, Stroke 1000 μm, Time 5 min, μm | | 170 | — | — | — | 150 |

| | | RACING OIL | | | |
|---|---|---|---|---|---|
| Test | Method | 0W20 (F) | 0W20 (G) | 0W20 (H) | 0W20 (I) |
| Kinematic Viscosity @ 40° C., cSt | ASTM D 445 | 38.39 | 36.68 | 35.48 | 35.35 |
| Kinematic Viscosity @ 100° C., cSt | ASTM D 445 | 6.69 | 6.48 | 6.43 | 6.40 |
| Viscosity Index | ASTM D 2270 | 131 | 130 | 135 | 134 |
| HTHS Viscosity @ 150° C., cP | ASTM D 4683 | 2.31 | 2.22 | 2.19 | 2.21 |
| Low-Temp Cranking Visc. @ −35° C., cP | ASTM D 5293 | 6,100 | 5,720 | 5,700 | 5,600 |
| Shear Stability, 30 Passes | ASTM D 6278 | | | | |
| Viscosity @ 100° C., New, cSt | | — | — | — | — |
| Viscosity @ 100° C., Sheared, cSt | | — | — | — | — |
| Viscosity loss, % | | | | | |
| Waring Blender Foam, 150° F. | | | | | |
| Appearance, inches | | — | — | — | — |
| Break Time, min. | | — | — | — | — |
| API Gravity @ 15.56° C. (60° F.) | | 34.3 | 34.3 | 34.3 | 34.3 |
| Density @ 15.56° C. (60° F.), g/cm3 | ASTM D 4052 | 0.8528 | 0.8527 | 0.8530 | 0.8525 |
| Specific Gravity @ 60/15.56° C. (60° F.) | ASTM D 4052 | 0.8536 | 0.8535 | 0.8540 | 0.8533 |
| HFRR | | | | | |
| Avg. Contact Film 1% @ 80° C. | | 4.0 | — | — | — |
| Avg. Contact Film 2% @ 100° C. | | 56.0 | — | — | — |
| Avg. Contact Film | | 65.0 | — | — | — |

-continued

| | | | | |
|---|---|---|---|---|
| 3% @ 120° C. | | | | |
| Avg. Contact Film 4% @ 140° C. | 76.0 | — | — | — |
| Avg. Contact Film 5% @ 160° C. | 71.0 | — | — | — |
| Avg. Contact Film 6% @ 180° C. | 66.0 | — | — | — |
| Avg. Friction Coeff. 1% @ 80° C. | 0.114 | — | — | — |
| Avg. Friction Coeff. 2 % @ 120° C. | 0.094 | — | — | — |
| Avg. Friction Coeff. 3 % @ 140° C. | 0.058 | — | — | — |
| Avg. Friction Coeff. 4 % @ 160° C. | 0.051 | — | — | — |
| Avg. Friction Coeff. 5 % @ 180° C. | 0.055 | — | — | — |
| Avg.Friction Coeff. 6 @ 180° C. | 0.060 | — | — | — |
| Avg. Wear Scar @ Load 400 g, Stroke 1000 μm, Time 5 min, μm | 145 | — | — | — |

— indicates test not run

0W20 Elemental Analysis:

Elemental analysis of the foregoing racing oil formulations was performed as described in more detail above, yielding the following results:

| | RACING OIL | | | | | | | |
|---|---|---|---|---|---|---|---|---|
| Test | 0W20 (A) | 0W20 (B) | 0W20 (C) | 0W20 (E) | 0W20 (F) | 0W20 (G) | 0W20 (H) | 0W20 (I) |
| XRF Lubricant Elements | | | | | | | | |
| Calcium, ppm | 910 | — | — | 890 | 870 | 890 | 880 | 910 |
| Chlorine, ppm | <40 | — | — | <40 | <40 | <40 | <40 | <80 |
| Copper, ppm | <20 | — | — | <20 | <20 | <20 | <20 | <40 |
| Iron, ppm | <20 | — | — | <20 | <20 | <20 | <20 | <40 |
| Magnesium, ppm | <40 | — | — | <40 | <40 | <40 | <40 | <80 |
| Molybdenum, ppm | 650 | — | — | 660 | 630 | 780 | 730 | 650 |
| Phosphorus, ppm | 1120 | — | — | 1800 | 1790 | 1820 | 1820 | 1840 |
| Potassium, ppm | <80 | — | — | <80 | <80 | <80 | <80 | <160 |
| Silicon, ppm | <40 | — | — | <40 | <40 | <40 | 30 | <80 |
| Sodium, ppm | <100 | — | — | <100 | <100 | <100 | <100 | <190 |
| Sulfur, ppm | 3190 | — | — | 4640 | 4600 | 4690 | 4690 | 4830 |
| Zinc, ppm | 1240 | — | — | 1980 | 1980 | 1960 | 1940 | 1990 |

17.5W35 Properties:

| | | RACING OIL | | | | |
|---|---|---|---|---|---|---|
| Test | Method | 17.5W35 (A) | 17.5W35 (B) | 17.5W35 (C) | 17.5W35 (D) | 17.5W35 (E) |
| Kinematic Viscosity @ 40° C., cSt | ASTM D 445 | 99.59 | 105.6 | 95.46 | 101.2 | 97.97 |
| Kinematic Viscosity @ 100° C., cSt | ASTM D 445 | 12.74 | 13.25 | 12.37 | 12.70 | 12.54 |
| Viscosity Index | ASTM D 2270 | 123 | 123 | 123 | 120 | 122 |
| HTHS Viscosity @ 150° C., cP | ASTM D 4683 | 3.80 | 4.00 | — | 3.91 | 3.86 |
| Low-Temp Cranking Visc. @ −15° C., cP | ASTM D 5293 | — | — | — | 4,560 | 4,370 |
| Low-Temp Cranking Visc. @ −20° C., cP | ASTM D 5293 | 7,190 | 7,780 | 7,180 | 7,460 | 7,180 |

-continued

| Test | Method | RACING OIL 17.5W35 (A) | 17.5W35 (B) | 17.5W35 (C) | 17.5W35 (D) | 17.5W35 (E) |
|---|---|---|---|---|---|---|
| Low-Temp Cranking Visc. @ −25° C., cP | ASTM D 5293 | 12,800 | — | — | — | — |
| Viscosity @ 100° C., New, cSt | | 12.72 | — | — | — | — |
| Viscosity @ 100° C., Sheared, cSt | | 12.53 | — | — | — | — |
| Viscosity loss, % | | 1.49 | — | — | — | — |
| Waring Blender Foam, 150° F. | | | | | | |
| Appearance, inches | | No Foam | — | — | No Foam | — |
| Break Time, min. | | 0.00 | — | — | 0.00 | — |
| API Gravity @ 15.56° C. (60° F.) | | 31.6 | — | — | 31.2 | — |
| Density @ 15.56° C. (60° F.), g/cm3 | ASTM D 4052 | 0.8668 | — | — | 0.8689 | — |
| Specific Gravity @ 60/15.56° C. (60° F.) | ASTM D 4052 | 0.8677 | — | — | 0.8697 | — |
| HFRR | | | | | | |
| Avg. Contact Film 1% @ 80° C. | | 25.1 | — | — | 47.9 | — |
| Avg. Contact Film 2% @ 100° C. | | 39.1 | — | — | 79.1 | — |
| Avg. Contact Film 3% @ 120° C. | | 84.1 | — | — | 88.4 | — |
| Avg. Contact Film 4% @ 140° C. | | 94.6 | — | — | 86.5 | — |
| Avg. Contact Film 5% @ 160° C. | | 95.2 | — | — | 87.2 | — |
| Avg. Contact Film 6% @ 180° C. | | 95.8 | — | — | 77.4 | — |
| Avg. Friction Coeff. 1% @ 80° C. | | 0.114 | — | — | 0.106 | — |
| Avg. Friction Coeff. 2% @ 100° C. | | 0.113 | — | — | 0.089 | — |
| Avg. Friction Coeff. 3% @ 120° C. | | 0.093 | — | — | 0.047 | — |
| Avg. Friction Coeff. 4% @ 140° C. | | 0.059 | — | — | 0.047 | — |
| Avg. Friction Coeff. 5% @ 160° C. | | 0.048 | — | — | 0.048 | — |
| Avg. Friction Coeff. 6 @ 180° C. | | 0.046 | — | — | 0.057 | — |
| Avg. Wear Scar @ Load 400 g, Stroke 1000 μm, Time 5 min, μm | | 130 | — | — | 165 | — |

17.5W35 Elemental Analysis:

Elemental analysis of the foregoing racing oil formulations was performed as described in more detail above, yielding the following results:

| XRF Lubricant Elements | RACING OIL 17.5W35 (A) | 17.5W35 (B) | 17.5W35 (D) | 17.5W35 (E) |
|---|---|---|---|---|
| Calcium, ppm | 900 | 910 | 850 | 870 |
| Chlorine, ppm | <40 | <40 | <40 | <40 |
| Copper, ppm | <20 | <20 | <20 | <20 |
| Iron, ppm | <20 | <20 | <20 | <20 |
| Magnesium, ppm | <40 | <40 | <40 | <40 |

-continued

| XRF Lubricant Elements | RACING OIL 17.5W35 (A) | 17.5W35 (B) | 17.5W35 (D) | 17.5W35 (E) |
|---|---|---|---|---|
| Molybdenum, ppm | 700 | 670 | 680 | 730 |
| Phosphorus, ppm | 1090 | 1120 | 1810 | 1840 |
| Potassium, ppm | <80 | <80 | <80 | <80 |
| Silicon, ppm | <40 | <40 | 30 | <40 |
| Sodium, ppm | <100 | <100 | <100 | <100 |
| Sulfur, ppm | 3130 | 3170 | 4690 | 4680 |
| Zinc, ppm | 1180 | 1200 | 1980 | 2040 |

7.5W35 Properties:

| Test | Method | RACING OIL 7.5W35 (A) | 7.5W35 (B) | 7.5W35 (C) | 7.5W35 (D) | 7.5W35 (E) | 7.5W35 (F) |
|---|---|---|---|---|---|---|---|
| Kinematic Viscosity @ 40° C., cSt | ASTM D 445 | 110.7 | 83.51 | 82.67 | 87.80 | 82.00 | 82.86 |
| Kinematic Viscosity @ 100° C., cSt | ASTM D 445 | 13.14 | 12.21 | 12.54 | 12.80 | 12.30 | 12.40 |
| Viscosity Index | ASTM D 2270 | 114 | 142 | 149 | 144 | 146 | 146 |
| HTHS Viscosity @ 150° C., Cp | ASTM D 4683 | 3.81 | — | — | 3.66 | 3.53 | 3.59 |
| Low-Temp Cranking Visc. @ −25° C., cP | ASTM D 5293 | 6,080 | 5,890 | 5,710 | 5,290 | 5,080 | 5,140 |
| Low-Temp Cranking Visc. @ −30° C., cP | ASTM D 5293 | 10,864 | 10,630 | 10,340 | 9,370 | 9,110 | 9,220 |
| Shear Stability, 30 Passes | ASTM D 6278 | | — | — | — | — | — |
| Viscosity @ 100° C., New, cSt | | 13.10 | — | — | — | — | — |
| Viscosity @ 100° C., Sheared, cSt | | 13.00 | — | — | — | — | — |
| Viscosity loss, % | | 0.76 | — | — | — | — | — |
| Waring Blender Foam, 150° F. | | | | | | | |
| Appearance, inches | | No Foam | — | — | — | — | — |
| Break Time, min. | | 0.00 | — | — | — | — | — |

-continued

| Test | Method | RACING OIL 7.5W35 (A) | 7.5W35 (B) | 7.5W35 (C) | 7.5W35 (D) | 7.5W35 (E) | 7.5W35 (F) |
|---|---|---|---|---|---|---|---|
| API Gravity @ 15.56° C. (60° F.) | | 32.1 | — | — | 32.0 | 32.0 | 31.8 |
| Density @ 15.56° C. (60° F.), g/cm3 | ASTM D 4052 | 0.8638 | — | — | 0.8647 | 0.8645 | 0.8655 |
| Specific Gravity @ 60/15.56° C. (60° F.) | ASTM D 4052 | 0.8647 | — | — | 0.8656 | 0.8654 | 0.8664 |
| HFRR | | | | | | | |
| Avg. Contact Film 1% @ 80° C. | | 24.6 | — | — | — | — | — |
| Avg. Contact Film 2% @ 100° C. | | 34.1 | — | — | — | — | — |
| Avg. Contact Film 3% @ 120° C. | | 68.4 | — | — | — | — | — |
| Avg. Contact Film 4% @ 140° C. | | 84.6 | — | — | — | — | — |
| Avg. Contact Film 5% @ 160° C. | | 93.6 | — | — | — | — | — |
| Avg. Contact Film 6% @ 180° C. | | 94.2 | — | — | — | — | — |
| Avg. Friction Coeff. 1% @ 80° C. | | 0.115 | — | — | — | — | — |
| Avg. Friction Coeff. 2% @ 100° C. | | 0.115 | — | — | — | — | — |
| Avg. Friction Coeff. 3% @ 120° C. | | 0.091 | — | — | — | — | — |
| Avg. Friction Coeff. 4% @ 140° C. | | 0.063 | — | — | — | — | — |
| Avg. Friction Coeff. 5% @ 160° C. | | 0.052 | — | — | — | — | — |
| Avg. Friction Coeff. 6 @ 180° C. | | 0.049 | — | — | — | — | — |
| Avg. Wear Scar @ Load 400 g, Stroke 1000 μm, Time 5 min, μm | | 185 | — | — | — | — | — |

7.5W35 Elemental Analysis:

Elemental analysis of the foregoing racing oil formulations was performed as described in more detail above, yielding the following results:

| XRF Lubricant Elements | RACING OIL 7.5W35 (A) | 7.5W35 (D) | 7.5W35 (E) | 7.5W35 (F) |
|---|---|---|---|---|
| Calcium, ppm | 900 | 860 | 880 | 880 |
| Chlorine, ppm | <40 | <40 | <40 | <40 |
| Copper, ppm | <20 | <20 | <20 | <20 |
| Iron, ppm | <20 | <20 | <20 | <20 |
| Magnesium, ppm | <40 | <40 | <40 | <40 |

-continued

| XRF Lubricant Elements | RACING OIL 7.5W35 (A) | 7.5W35 (D) | 7.5W35 (E) | 7.5W35 (F) |
|---|---|---|---|---|
| Molybdenum, ppm | 660 | 720 | 820 | 780 |
| Phosphorus, ppm | 1080 | 1930 | 1880 | 2000 |
| Potassium, ppm | <80 | <80 | <80 | <80 |
| Silicon, ppm | <40 | <40 | <40 | <40 |
| Sodium, ppm | <100 | <100 | <100 | <100 |
| Sulfur, ppm | 3120 | 4920 | 4940 | 5220 |
| Zinc, ppm | 1200 | 2080 | 2070 | 2190 |

15W50 Properties:

| Test | Method | RACING OIL 15W50 (A) | 15W50 (B) | 15W50 (C) | 15W50 (D) | 15W50 (E) | 15W50 (F) | 15W50 (G) | 15W50 (H) |
|---|---|---|---|---|---|---|---|---|---|
| Kinematic Viscosity @ 40° C., cSt | ASTM D 445 | 157.1 | 146.1 | 142.4 | 146.9 | 143.0 | 145.4 | 144.8 | 142.5 |
| Kinematic Viscosity @ 100° C., cSt | ASTM D 445 | 19.74 | 18.65 | 18.36 | 18.84 | 18.64 | 18.90 | 18.45 | 18.40 |
| Viscosity Index | ASTM D 2270 | 145 | 144 | 145 | 145 | 147 | 147 | 143 | 145 |
| HTHS Viscosity @ 150° C., cP | ASTM D 4683 | 5.17 | 4.84 | 4.79 | 4.83 | — | 4.88 | 4.84 | 4.73 |
| Low-Temp Cranking Visc. @ −20° C., cP | ASTM D 5293 | 6,990 | 6,550 | 6,230 | 6,540 | 6,290 | 6,490 | 6,430 | 6,330 |
| Waring Blender Foam, 150° F. | | | | | | | | | |
| Appearance, inches | | 1.0 | — | — | — | — | — | No Foam | — |
| Break Time, min. | | 1.17 | — | — | — | — | — | 0.00 | — |
| API Gravity @ 15.56° C. (60° F.) | | 31.3 | 31.5 | 31.4 | 31.4 | — | 31.0 | 31.1 | 31.1 |
| Density @ 15.56° C. (60° F.), g/cm3 | ASTM D 4052 | 0.8684 | 0.8674 | 0.8676 | 0.8676 | — | 0.8700 | 0.8695 | 0.8697 |
| Specific Gravity @ 60/15.56° C. (60° F.) | ASTM D 4052 | 0.8693 | 0.8682 | 0.8684 | 0.8684 | — | 0.8708 | 0.8704 | 0.8705 |
| Shear Stability, 30 Passes | ASTM D 6278 | | — | — | — | — | — | — | — |

-continued

| Test | Method | RACING OIL 15W50 (A) | 15W50 (B) | 15W50 (C) | 15W50 (D) | 15W50 (E) | 15W50 (F) | 15W50 (G) | 15W50 (H) |
|---|---|---|---|---|---|---|---|---|---|
| Viscosity @ 100° C., New, cSt | | 19.69 | — | — | — | — | — | — | |
| Viscosity @ 100° C., Sheared, cSt | | 19.24 | — | — | — | — | — | — | |
| Viscosity loss, % | | 2.29 | — | — | — | — | — | — | |
| HFRR | | | | | | | | | |
| Avg. Contact Film 1% @ 80° C. | | 49.3 | — | — | — | — | — | 88.4 | — |
| Avg. Contact Film 2% @ 100° C. | | 80.3 | — | — | — | — | — | 89.0 | — |
| Avg. Contact Film 3% @ 120° C. | | 73.2 | — | — | — | — | — | 89.0 | — |
| Avg. Contact Film 4% @ 140° C. | | 90.9 | — | — | — | — | — | 88.8 | — |
| Avg. Contact Film 5% @ 160° C. | | 92.3 | — | — | — | — | — | 87.8 | — |
| Avg. Contact Film 6% @ 180° C. | | 94.1 | — | — | — | — | — | 85.9 | — |
| Avg. Friction Coeff. 1 @ 80° C. | | 0.110 | — | — | — | — | — | 0.100 | — |
| Avg. Friction Coeff. 2 @ 100° C. | | 0.109 | — | — | — | — | — | 0.106 | — |
| Avg. Friction Coeff. 3 @ 120° C. | | 0.095 | — | — | — | — | — | 0.066 | — |
| Avg. Friction Coeff. 4 @ 140° C. | | 0.061 | — | — | — | — | — | 0.054 | — |
| Avg. Friction Coeff. 5 @ 160° C. | | 0.048 | — | — | — | — | — | 0.048 | — |
| Avg. Friction Coeff. 6 @ 180° C. | | 0.047 | — | — | — | — | — | 0.051 | — |
| Avg. Wear Scar @ Load 400 g, Stroke 1000 μm, Time 5 min, μm | | 140 | — | — | — | — | — | 130 | — |

15W50 Elemental Analysis:

Elemental analysis of the foregoing racing oil formulations was performed as described in more detail above, yielding the following results:

| XRF Lubricant Elements | RACING OIL 15W50 (A) | 15W50 (B) | 15W50 (C) | 15W50 (D) | 15W50 (E) | 15W50 (F) | 15W50 (G) | 15W50 (H) |
|---|---|---|---|---|---|---|---|---|
| Calcium, ppm | 890 | 940 | 890 | 890 | — | 870 | 870 | 880 |
| Chlorine, ppm | <40 | <40 | <40 | <40 | — | <40 | <40 | <40 |
| Copper, ppm | <20 | <20 | <20 | <20 | — | <20 | <20 | <20 |
| Iron, ppm | <20 | <20 | <20 | <20 | — | <20 | <20 | <20 |
| Magnesium, ppm | <40 | <40 | <40 | <40 | — | <40 | <40 | <40 |
| Molybdenum, ppm | 670 | 640 | 690 | 590 | — | 660 | 620 | 820 |
| Phosphorus, ppm | 1090 | 1100 | 1090 | 1090 | — | 1940 | 1780 | 1910 |
| Potassium, ppm | <80 | <80 | <80 | <80 | — | <80 | <80 | <80 |
| Silicon, ppm | <40 | <40 | <40 | <40 | — | <40 | <40 | <40 |
| Sodium, ppm | <100 | <100 | <100 | <100 | — | <100 | <100 | <100 |
| Sulfur, ppm | 3120 | 3170 | 3140 | 3130 | — | 4890 | 4620 | 4880 |
| Zinc, ppm | 1170 | 1180 | 1170 | 1190 | — | 2090 | 1950 | 2120 |

COMPARATIVE EXAMPLES

A number of commercial racing oil products were obtained. Comparative properties of the commercial products were measured. The results are given in the following Tables:

Properties:

| Test | Method | PRODUCT NAME | | | | | |
|---|---|---|---|---|---|---|---|
| | | RED LINE ® 10 WT RACE OIL | ROYAL PURPLE ® RACING 9 | VALVOLINE SYNTHETIC RACING SAE 5W-30 | KENDALL GT-1 ® FULL SYNTHETIC MOTOR OIL SAE 5W-30 | MOBIL 1 RACING SAE 0W-30 | ROYAL PURPLE ® SYNTHETIC OIL 5W-30 |
| Kinematic Viscosity @ 40° C., cSt | ASTM D 445 | 27.55 | 34.11 | 59.56 | 59.39 | 57.65 | 63.98 |
| Kinematic Viscosity @ 100° C., cSt | ASTM D 445 | 5.51 | 6.50 | 9.86 | 10.23 | 10.49 | 10.58 |
| Viscosity Index | ASTM D 2270 | 142 | 147 | 151 | 161 | 174 | 155 |
| HTHS Viscosity @ 150° C., cP | ASTM D 4683 | 2.02 | 2.13 | 2.99 | 3.08 | 3.01 | 3.11 |
| Shear Stability, 30 Passes | ASTM D 6278 | | | | | | |
| Viscosity @ 100° C., New, cSt | | 5.55 | 6.72 | 9.92 | 10.24 | — | 10.60 |
| Viscosity @ 100° C., Sheared, cSt | | 5.46 | 6.45 | 8.90 | 9.59 | — | 8.91 |
| Viscosity Loss, % | | 1.62 | 4.02 | 10.28 | 6.35 | — | 15.94 |
| Waring Blender Foam, 150° F. | | | | | | | |
| Appearance, inches | | 1.0 | 1.0 | 1.0 | 1.0 | — | 1.0 |
| Break Time, min. | | 3.58 | 0.52 | 4.53 | 0.75 | — | 5.50 |
| API Gravity @ 15.56° C. (60° F.) | Calc. per ASTM D 287-92 | 27.5 | 32.1 | 34.6 | 34.1 | 33.8 | 31.9 |
| Density @ 15.56° C. (60° F.), g/cm3 | ASTM D 4052 | 0.8892 | 0.8642 | 0.8509 | 0.8536 | 0.8550 | 0.8649 |
| Specific Gravity @ 60/15.56° C. (60° F.) | ASTM D 4052 | 0.8900 | 0.8650 | 0.8518 | 0.8544 | 0.8560 | 0.8658 |
| HFRR | | | | | | | |
| Avg. Contact Film 1% @ 80° C. | | 1.0 | 1.0 | 39.0 | 83.0 | 4.3 | 65.0 |
| Avg. Contact Film 2% @ 100° C. | | 0.0 | 0.0 | 93.0 | 94.0 | 36.3 | 96.0 |
| Avg. Contact Film 3% @ 120° C. | | 0.0 | 0.0 | 95.0 | 96.0 | 27.8 | 96.0 |
| Avg. Contact Film 4% @ 140° C. | | 0.0 | 0.0 | 97.0 | 97.0 | 31.4 | 97.0 |
| Avg. Contact Film 5% @ 160° C. | | 0.0 | 0.0 | 78.0 | 96.0 | 42.3 | 97.0 |
| Avg. Contact Film 6% @ 180° C. | | 0.0 | 0.0 | 47.0 | 93.0 | 47.4 | 97.0 |
| Avg.Friction Coeff. 1 @ 80° C. | | 0.144 | 0.134 | 0.117 | 0.117 | 0.129 | 0.119 |
| Avg.Friction Coeff. 2 @ 100° C. | | 0.152 | 0.160 | 0.116 | 0.108 | 0.142 | 0.109 |
| Avg.Friction Coeff. 3 @ 120° C. | | 0.155 | 0.159 | 0.089 | 0.105 | 0.139 | 0.106 |
| Avg.Friction Coeff. 4 @ 140° C. | | 0.158 | 0.146 | 0.075 | 0.101 | 0.140 | 0.103 |
| Avg.Friction Coeff. 5 @ 160° C. | | 0.157 | 0.145 | 0.083 | 0.100 | 0.138 | 0.103 |
| Avg.Friction Coeff. 6 @ 180° C. | | 0.153 | 0.141 | 0.093 | 0.100 | 0.135 | 0.098 |
| Avg. Wear Scar @ Load 400 g, Stroke 1000 μm, Time 5 min, μm | | 235 | 390 | 170 | 160 | 210 | 215 |

Additional product analyses gave the results in the following Table:

| Test | Method | Product Name | | | | | |
|---|---|---|---|---|---|---|---|
| | | MOBIL 1 0W-30 | MOBIL 1 5W-50 | VALVOLINE RACING SAE 20W-50 | LUCAS SYNTHETIC 20/50 PLUS | AMSOIL SERIES 2000 20W-50 SYNTHETIC RACING OIL | RED LINE ® HIGH PERFORMANCE MOTOR OIL SAE 15W-50 |
| Kinematic Viscosity @ 40° C., cSt | ASTM D 445 | 59.34 | 122.7 | 125.4 | 107.7 | 133.1 | 140.4 |
| Kinematic Viscosity @ 100° C., cSt | ASTM D 445 | 10.63 | 17.10 | 17.17 | 17.25 | 18.69 | 19.51 |

-continued

| Test | Method | Product Name | | | | | |
|---|---|---|---|---|---|---|---|
| | | MOBIL 1 0W-30 | MOBIL 1 5W-50 | VALVOLINE RACING SAE 20W-50 | LUCAS SYNTHETIC 20/50 PLUS | AMSOIL SERIES 2000 20W-50 SYNTHETIC RACING OIL | RED LINE ® HIGH PERFORMANCE MOTOR OIL SAE 15W-50 |
| Viscosity Index | ASTM D 2270 | 171 | 153 | 150 | 176 | 159 | 160 |
| HTHS Viscosity @ 150° C., cP | ASTM D 4683 | 2.96 | 4.51 | 5.16 | 4.63 | 5.34 | 5.73 |
| Shear Stability, 30 Passes | ASTM D 6278 | | | | | | |
| Viscosity @ 100° C., New, cSt | | 10.61 | 17.04 | 17.20 | 17.26 | 18.74 | 19.52 |
| Viscosity @ 100° C., Sheared, cSt | | 10.44 | 16.49 | 16.52 | 14.18 | 16.95 | 17.74 |
| Viscosity Loss, % | | 1.60 | 3.23 | 3.95 | 17.84 | 9.55 | 9.12 |
| HFRR | | | | | | | |
| Avg. Contact Film 1% @ 80° C. | | 11.0 | 25.5 | 87.0 | 65.0 | 59.0 | 1.0 |
| Avg. Contact Film 2% @ 100° C. | | 34.0 | 21.6 | 83.0 | 97.0 | 91.0 | 0.0 |
| Avg. Contact Film 3% @ 120° C. | | 38.0 | 24.5 | 90.0 | 97.0 | 96.0 | 0.0 |
| Avg. Contact Film 4% @ 140° C. | | 51.0 | 38.3 | 81.0 | 97.0 | 97.0 | 0.0 |
| Avg. Contact Film 5% @ 160° C. | | 56.0 | 49.6 | 81.0 | 96.0 | 97.0 | 0.0 |
| Avg. Contact Film 6% @ 180° C. | | 58.0 | 48.2 | 71.0 | 95.0 | 96.0 | 46.0 |
| Avg.Friction Coeff. 1 @ 80° C. | | 0.121 | 0.118 | 0.101 | 0.124 | 0.119 | 0.125 |
| Avg.Friction Coeff. 2 @ 100° C. | | 0.127 | 0.124 | 0.093 | 0.116 | 0.111 | 0.129 |
| Avg.Friction Coeff. 3 @ 120° C. | | 0.131 | 0.126 | 0.077 | 0.111 | 0.105 | 0.137 |
| Avg.Friction Coeff. 4 @ 140° C. | | 0.132 | 0.125 | 0.081 | 0.101 | 0.099 | 0.137 |
| Avg.Friction Coeff. 5 @ 160° C. | | 0.133 | 0.127 | 0.077 | 0.093 | 0.093 | 0.135 |
| Avg.Friction Coeff. 6 @ 180° C. | | 0.133 | 0.129 | 0.075 | 0.089 | 0.087 | 0.120 |
| Avg. Wear Scar @ Load 400 g, Stroke 1000 μm, Time 5 min, μm | | 220 | 265 | 145 | 195 | 170 | 170 |

Elemental Analysis:

An elemental analysis of the commercial products was performed, yielding the results described in the following Tables:

| XRF Lubricant Elements | Product Name | | | | | |
|---|---|---|---|---|---|---|
| | RED LINE ® 10 WT RACE OIL | ROYAL PURPLE ® RACING 9 | VALVOLINE SYNTHETIC RACING SAE 5W-30 | KENDALL GT-1 ® FULL SYNTHETIC MOTOR OIL SAE 5W-30 | MOBIL 1 RACING SAE 0W-30 | ROYAL PURPLE ® SYNTHETIC OIL 5W-30 |
| Calcium, ppm | 1180 | 2470 | 880 | 2610 | 3510 | 2050 |
| Chlorine, ppm | 80 | 100 | 60 | 60 | <40 | 110 |
| Copper, ppm | <20 | <20 | <20 | <20 | <20 | <20 |
| Iron, ppm | <20 | <20 | <20 | <20 | <20 | <20 |
| Magnesium, ppm | <40 | <40 | <40 | <40 | <40 | <40 |
| Molybdenum, ppm | 890 | 220 | 410 | 40 | 120 | 190 |
| Phosphorus, ppm | 4080 | 1190 | 1360 | 1120 | 1850 | 1080 |
| Potassium, ppm | <80 | <80 | <80 | <80 | <80 | <80 |
| Silicon, ppm | <40 | <40 | <40 | <40 | <40 | <40 |
| Sodium, ppm | <100 | <100 | <100 | <100 | <100 | <100 |
| Sulfur, ppm | 14160 | 39260 | 4070 | 3450 | 4340 | 15440 |
| Zinc, ppm | 3750 | 2160 | 1550 | 1260 | 1980 | 1230 |

| XRF Lubricant Elements | Product Name | | | | | |
|---|---|---|---|---|---|---|
| | MOBIL 1 0W-30 | MOBIL 1 5W-50 | VALVOLINE RACING SAE 20W-50 | LUCAS SYNTHETIC 20/50 PLUS | AMSOIL SERIES 2000 20W-50 SYNTHETIC RACING OIL | RED LINE ® HIGH PERFORMANCE MOTOR OIL SAE 15W-50 |
| Calcium, ppm | 3320 | 3260 | 840 | 2250 | 2580 | 2620 |
| Chlorine, ppm | <40 | <40 | 60 | <40 | <40 | 130 |
| Copper, ppm | <20 | <20 | <20 | <20 | <20 | <20 |
| Iron, ppm | <20 | <20 | <20 | <20 | <20 | <20 |
| Magnesium, ppm | <40 | <40 | <40 | <40 | 680 | <40 |
| Molybdenum, ppm | 110 | 100 | 720 | 80 | <20 | 530 |
| Phosphorus, ppm | 1010 | 1380 | 1210 | 1160 | 1120 | 1330 |
| Potassium, ppm | <80 | <80 | <80 | <80 | <80 | 60 |
| Silicon, ppm | <40 | <40 | <40 | <40 | <40 | <40 |
| Sodium, ppm | <100 | <100 | <100 | <100 | <100 | <100 |
| Sulfur, ppm | 2560 | 3350 | 3690 | 3320 | 4910 | 6760 |
| Zinc, ppm | 1130 | 1500 | 1370 | 1300 | 1230 | 1320 |

The results demonstrate that the experimental racing oil formulations showed greater friction reduction over the temperature range than any of the competitive commercial products. With the exception of one sample, contact resistance showed a contact film increase with increase in temperature.

Persons of ordinary skill in the art will recognize that many modifications may be made to the foregoing without departing from the spirit and scope thereof. The embodiment described herein is meant to be illustrative only and should not be taken as limiting the invention, which is defined in the following claims.

We claim:

1. An automotive racing oil comprising:

base oil comprising polyalphaolefin and racing oil components effective to produce automotive racing oil properties comprising a kinematic viscosity of from about 3.2 centistokes (cSt) to about 25 cSt at 100° C., and a coefficient of friction of about 0.065 or less at 180° C.;

the racing oil components comprising:

one or more oil-soluble molybdenum compound selected from the group consisting of molybdenum dithiocarbamates and molybdenum dithiophosphates, the automotive racing oil having a molybdenum concentration of more than 360 ppm, as measured by X-ray fluorescence;

one or more anti-wear additive comprising zinc selected from the group consisting of zinc dihydrocarbyl dithiophosphates and zinc dihydrocarbyl dithiocarbamates, the automotive racing oil having a zinc concentration of about 1400 ppm or more, as measured by X-ray fluorescence; and, a quantity of a combination of esters maintaining the racing oil components in solution in the base oil, the combination of esters comprising one or more multiester(s) and one or more polyol monoester(s), wherein the one or more multiester(s) are selected from the group consisting of tricarboxylic acid triesters.

2. The automotive racing oil of claim 1, the racing oil components further comprising:

one or more detergents comprising metal having a valence of +2, the automotive racing oil having a concentration of metal having a valence of +2 of from about 550 ppm to about 2500 ppm;

one or more dispersant comprising nitrogen contributing a nitrogen concentration of from about 200 ppm to about 2800 ppm in the automotive racing oil;

from about 0.5 to about 2 wt. %, based on the total weight of the racing oil, of one or more antioxidant selected from the group consisting of aminic antioxidant, phenolic antioxidant, and combinations thereof; and, from about 8 ppm to about 25 ppm antifoaming agent.

3. The automotive racing oil of claim 1 wherein the oil-soluble molybdenum compound is selected from the group consisting of dithiocarbamates and dithiophosphates having the following general structure:

$$(MoXY)_a[S\text{-}Z]_n$$

wherein a is from 1 to 2;

n is 2;

X and Y are selected from the group consisting of oxygen, sulfur, and nothing; and, Z is selected from groups having the following general structure:

1)

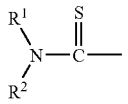

2)

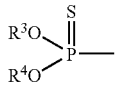

wherein $R^1$ to $R^4$ independently are selected from the group consisting of alkyl groups, aryl groups, aralkyl groups, alkoxyalkyl groups, cycloalkyl groups, and cycloalkenyl groups having from 1 to about 30 carbon atoms.

4. The automotive racing oil of claim 3 wherein $R^1$ and $R^2$ are alkyl groups having from about 2 to 12 carbon atoms.

5. The automotive racing oil of claim 2 wherein the oil-soluble molybdenum compound is selected from the group consisting of:

mononuclear dithiocarbamates having the following general structure:

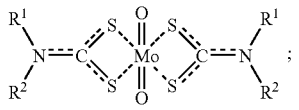

di-nuclear dithiocarbamates having the following general structure:

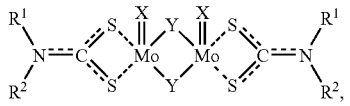

wherein $R^1$ and $R^2$ are selected from the group consisting of alkyl groups, aryl groups, aralkyl groups, alkoxyalkyl groups, cycloalkyl groups, and cycloalkenyl groups having from 1 to about 30 carbon atoms;

X and Y are selected from the group consisting of sulfur and oxygen; and, molybdenum oxysulfide compounds have the following general structure:

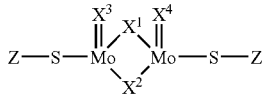

wherein $X^1$-$X^4$ independently are selected from the group consisting of a sulfur atom and an oxygen atom; and Z is selected from groups having the following general structure:

1)

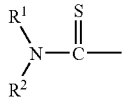

2)

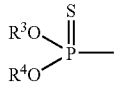

wherein R1 to R4 independently are selected from the group consisting of alkyl groups, aryl groups, aralkyl groups, alkoxyalkyl groups, cycloalkyl groups, and cycloalkenyl groups having from 1 to about 30 carbon atoms.

6. The automotive racing oil of claim 5 wherein $R^1$, $R^2$, $R^3$, and $R^4$ are alkyl groups having from about 2 to 12 carbon atoms.

7. The automotive racing oil of claim 6 wherein the zinc concentration is about 1500 ppm or more.

8. The automotive racing oil of claim 7 wherein the zinc concentration is about 2600 ppm or less; and, the molybdenum concentration is about 500 ppm or more.

9. The automotive racing oil of claim 3 wherein the one or more polyol monoester(s) have the following general structure:

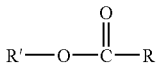

wherein R is selected from the group consisting of alkyl groups and alkenyl groups having about 14 carbon atoms or more and R' is a polyhydric alcohol having from about 3 to about 6 carbon atoms;

wherein when the base oil has a viscosity of from about 2 to about 10 cSt at 100° C., the one or more multiester(s) further include a compound selected from the group consisting of diester(s) having the following general structure:

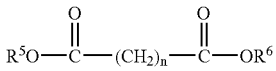

wherein n is from about 4 to about 10; and $R^5$ and $R^6$ are selected from the group consisting of alkyl groups and alkenyl groups having about 10 carbon atoms or more; and, wherein when the base oil has a viscosity of about 10 cSt or more at 100° C., the one or more multiester(s) includes an aromatic carboxylic acid triester.

10. The automotive racing oil of claim 9 wherein the base oil has a viscosity of about 10 cSt or more at 100° C., and the multiester is a tricarboxylic acid triester compound wherein the ester group comprises alkyl groups independently having from about 4 to about 18 carbon atoms.

11. The automotive racing oil of claim 3 wherein the one or more multiester(s) are selected from the group consisting of isodecyl trimellitate, tridecyl trimellitate, and combinations thereof; and the one or more polyol monoester(s) are selected from the group consisting of glycerol monoesters, trimethylolpropane monoesters, and pentaerythritol monoesters.

12. The automotive racing oil of claim 1 comprising from about 5.5 wt. % to about 22 wt. % of the combination of esters, the one or more polyol monoester(s) comprising glycerol monooleate.

13. The automotive racing oil of claim 3 wherein the anti-wear additive comprises one or more zinc dihydrocarbyl dithiophosphates having the following general structure:

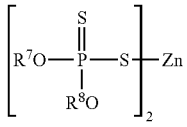

wherein $R^7$ and $R^8$ are the same or different secondary hydrocarbyl radicals having from 1 to 18 carbon atoms, the hydrocarbyl radicals being selected from the group consisting of alkyl, alkenyl, aryl, arylalkyl, alkaryl, and cycloaliphatic radicals.

14. The automotive racing oil of claim 13 wherein $R^7$ and $R^8$ are selected from the group consisting of alkyl groups having from about 2 to about 8 carbon atoms, provided that one or more of $R^7$ or $R^8$ comprises 5 or more carbon atoms.

15. The automotive racing oil of claim 13 wherein $R^7$ is an alkyl group having 3 carbon atoms and $R^8$ is an alkyl group having 6 carbon atoms.

16. An automotive racing oil comprising:

base oil comprising polyalphaolefin and racing oil components effective to produce automotive racing oil properties comprising a kinematic viscosity of from about 3.2 centistokes (cSt) to about 25 cSt at 100° C. and a coefficient of friction of about 0.065 or less at 180° C.;

the racing oil components comprising:

one or more oil-soluble molybdenum compound selected from the group consisting of molybdenum dithiocarbamates and molybdenum dithiophosphates, the automotive racing oil having a molybdenum concentration of more than 360 ppm, as measured by X-ray fluorescence; and, one or more anti-wear additive comprising zinc selected from the group consisting of zinc dihydrocarbyl dithiophosphates and zinc dihydrocarbyl dithiocarbamates, the automotive racing oil having a zinc concentration of about 2000 ppm or more, as measured by X-ray fluorescence; and, a quantity of a combination of esters maintaining the racing oil components in solution in the base oil, the combination of esters comprising one or more multiester(s) and one or more polyol monoester(s), wherein the one or more multiester(s) are selected from the group consisting of tricarboxylic acid triesters.

17. The automotive racing oil of claim 16, the racing oil components further comprising:

one or more detergents comprising metal having a valence of +2, the automotive racing oil having a concentration of metal having a valence of +2 of from about 550 ppm to about 2500 ppm;

one or more dispersant comprising nitrogen contributing a nitrogen concentration of from about 200 ppm to about 2800 ppm in the automotive racing oil; and, from about 0.5 to about 2 wt. %, based on the total weight of the racing oil, of one or more antioxidant selected from the group consisting of aminic antioxidant, phenolic antioxidant, and combinations thereof; and, from about 8 ppm to about 25 ppm antifoaming agent.

18. The automotive racing oil of claim 17 wherein the oil-soluble molybdenum compound is selected from the group consisting of dithiocarbamates and dithiophosphates having the following general structure:

$$(MoXY)_a[S\text{-}Z]_n$$

wherein a is from 1 to 2;

n is 2;

X and Y are selected from the group consisting of oxygen, sulfur, and nothing; and, Z is selected from groups having the following general structure:

1)

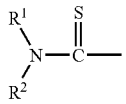

-continued

2)

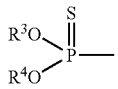

wherein $R^1$ to $R^4$ independently are selected from the group consisting of alkyl groups, aryl groups, aralkyl groups, alkoxyalkyl groups, cycloalkyl groups, and cycloalkenyl groups having from 1 to about 30 carbon atoms.

19. The automotive racing oil of claim 18 wherein R1 and R2 are alkyl groups having from about 2 to 12 carbon atoms.

20. The automotive racing oil of claim 17 wherein the oil-soluble molybdenum compound is selected from the group consisting of:

mononuclear dithiocarbamates having the following general structure:

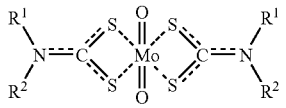

di-nuclear dithiocarbamates having the following general structure:

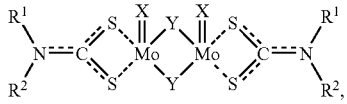

wherein $R^1$ and $R^2$ are selected from the group consisting of alkyl groups, aryl groups, aralkyl groups, alkoxyalkyl groups, cycloalkyl groups, and cycloalkenyl groups having from 1 to about 30 carbon atoms;

X and Y are selected from the group consisting of sulfur and oxygen; and, molybdenum oxysulfide compounds have the following general structure:

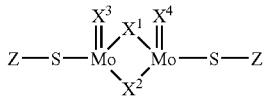

wherein $X^1$-$X^4$ independently are selected from the group consisting of a sulfur atom and an oxygen atom; and Z is selected from groups having the following general structure:

1)

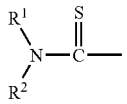

-continued

2)

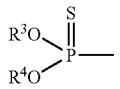

wherein $R^1$ to $R^4$ independently are selected from the group consisting of alkyl groups, aryl groups, aralkyl groups, alkoxyalkyl groups, cycloalkyl groups, and cycloalkenyl groups having from 1 to about 30 carbon atoms.

21. The automotive racing oil of claim 20 wherein $R^1$, $R^2$, $R^3$, and $R^4$ are alkyl groups having from about 2 to 12 carbon atoms.

22. The automotive racing oil of claim 21 wherein the zinc concentration is about 2600 ppm or less; and, the molybdenum concentration is 500 ppm or more.

23. The automotive racing oil of claim 18 wherein the one or more polyol monoester(s) have the following general structure:

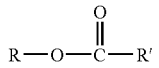

wherein R is selected from the group consisting of alkyl groups and alkenyl groups having about 14 carbon atoms or more and R' is a polyhydric alcohol having from about 3 to about 6 carbon atoms; and, wherein when the base oil has a viscosity of from about 2 to about 10 cSt at 100° C., the one or more multiester(s) further include a compound selected from the group consisting of diester(s) having the following general structure:

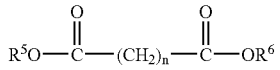

wherein n is from about 4 to about 10;

$R^5$ and $R^6$ are selected from the group consisting of alkyl groups and alkenyl groups having about 10 carbon atoms or more; and, when the base oil has a viscosity of about 10 cSt or more at 100° C., the one or more multiester(s) are aromatic carboxylic acid triester(s).

24. The automotive racing oil of claim 23 wherein the base oil has a viscosity of about 10 cSt or more at 100° C., and the one or more multiester(s) are aromatic tricarboxylic acid triester(s) wherein the ester group comprises alkyl groups independently having from about 4 to about 18 carbon atoms.

25. The automotive racing oil of claim 24 wherein the one or more multiester is selected from the group consisting of isodecyl trimellitate, tridecyl trimellitate, and combinations thereof; and the one or more polyol monoesters is selected from the group consisting of glycerol monoesters, trimethylolpropane monoesters, and pentaerythritol monoesters.

26. The automotive racing oil of claim 23 comprising from about 5.5 wt. % to about 22 wt. % of the combination of esters, the one or more polyol monoester(s) comprising glycerol monooleate.

27. The automotive racing oil of claim 26 wherein the anti-wear additive comprises one or more zinc dihydrocarbyl dithiophosphates having the following general structure:

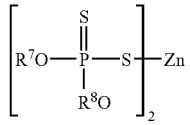

wherein $R^7$ and $R^8$ are the same or different secondary hydrocarbyl radicals having from 1 to 18 carbon atoms, the hydrocarbyl radicals being selected from the group consisting of alkyl, alkenyl, aryl, arylalkyl, alkaryl, and cycloaliphatic radicals.

28. The automotive racing oil of claim 27 wherein $R^7$ and $R^8$ are selected from the group consisting of alkyl groups having from about 2 to about 8 carbon atoms, provided that one or more of $R^7$ or $R^8$ comprises 5 or more carbon atoms.

29. The automotive racing oil of claim 28 wherein R7 is an alkyl group having 3 carbon atoms and R8 is an alkyl group having 6 carbon atoms.

30. The automotive racing oil of claim 17 wherein the anti-foaming agent comprises polydimethylsiloxane.

31. The automotive racing oil of claim 29 wherein the anti-foaming agent comprising polydimethylsiloxane.

32. An automotive racing oil comprising:

base oil comprising polyalphaolefin and racing oil components effective to produce automotive racing oil properties comprising a kinematic viscosity of from about 3.2 centistokes (cSt) to about 25 cSt at 100° C. and a coefficient of friction of about 0.065 or less at 180° C.;

the racing oil components comprising:

mononuclear dithiocarbamates having the following general structure:

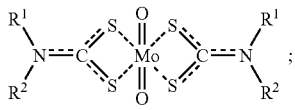

;

di-nuclear dithiocarbamates having the following general structure:

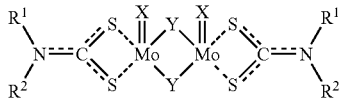

wherein $R^1$ and $R^2$ are selected from the group consisting of alkyl groups, aryl groups, aralkyl groups, alkoxyalkyl groups, cycloalkyl groups, and cycloalkenyl groups having from 1 to about 30 carbon atoms;

X and Y are selected from the group consisting of sulfur and oxygen; and, molybdenum oxysulfide compounds have the following general structure:

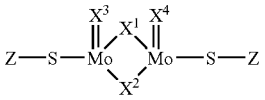

wherein $X^1$-$X^4$ independently are selected from the group consisting of a sulfur atom and an oxygen atom; and Z is selected from groups having the following general structure:

1)

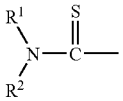

2)

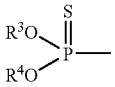

wherein $R^1$ to $R^4$ independently are selected from the group consisting of alkyl groups, aryl groups, aralkyl groups, alkoxyalkyl groups, cycloalkyl groups, and cycloalkenyl groups having from 1 to about 30 carbon atoms;

the automotive racing oil having a molybdenum concentration of from about 500 ppm to about 1200 ppm, as measured by X-ray fluorescence;

one or more zinc dihydrocarbyl dithiophosphates having the following general structure:

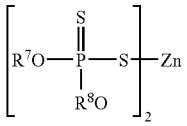

wherein $R^7$ is an alkyl group having 3 carbon atoms and $R^8$ is an alkyl group having 6 carbon atoms, the automotive racing oil having a zinc concentration of from about 2000 ppm to about 2600 ppm, as measured by X-ray fluorescence;

one or more detergent comprising calcium producing a calcium concentration of from about 550 ppm to about 900 ppm in the automotive racing oil, as measured by X-ray fluorescence;

one or more modified or unmodified succinimide comprising nitrogen, contributing a nitrogen concentration of about 500 ppm to about 1500 ppm in the automotive racing oil; and, from about 0.5 to about 2 wt. %, based on the total weight of the racing oil, of one or more antioxidant comprising a combination of hindered phenols and amines selected from the group consisting of diaryl amines and alkyl derivatives thereof, aryl naphthyl amines and alkyl derivatives thereof, and combinations thereof;

from about 8 ppm to about 25 ppm of one or more anti-foaming agent; and a combination of esters comprising one or more polyol monoesters having the following general structure:

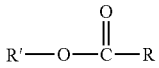

wherein R is selected from the group consisting of alkyl groups and alkenyl groups having about 14 carbon atoms or more and R' is a polyhydric alcohol having from about 3 to about 6 carbon atoms and one or more multiester(s) selected from the group consisting of tricarboxylic acid triesters.

33. The automotive racing oil of claim 32 wherein the one or more multiester(s) are selected from the group consisting of isodecyl trimellitate, tridecyl trimellitate, and combinations thereof; and the one or more polyol monoester(s) are selected from the group consisting of glycerol monoesters, trimethylolpropane monoesters, pentaerythritol monoesters, and combinations thereof.

34. The automotive racing oil of claim 32 comprising from about 5.5 wt. % to about 22 wt. % of the combination of esters, wherein the one or more polyol monoester(s) comprise glycerol monooleate.

35. The automotive racing oil of claim 34 wherein the detergent comprises calcium salicylate.

36. The automotive racing oil of claim 35 wherein the one or more antifoaming agent comprises polydimethylsiloxane; and, the one or more modified or unmodified succinimide is unmodified bissuccinimide.

37. The automotive racing oil of claim 36 comprising:

from about 65 wt. % to about 89 wt. % base oil;

a molybdenum concentration of about 720 ppm;

a nitrogen concentration of about 900 ppm to about 1000 ppm; and a calcium concentration of about 900 ppm;

an antifoaming agent concentration of about 10 ppm to about 20 ppm; and, about 1 wt. % of the antioxidant.

38. The automotive racing oil of claim 37 wherein $R^7$ is an alkenyl group having 17 carbon atoms;

$R^8$ has 3 carbon atoms.

39. A method for formulating automotive racing oil comprising:

providing base oil comprising polyalphaolefin; and mixing said base oil with racing oil components under conditions effective to produce the automotive racing oil comprising a kinematic viscosity of from about 3.2 centistokes (cSt) to about 25 cSt at 100° C., and a coefficient of friction of about 0.065 or less at 180° C., the racing oil components consisting essentially of:

a quantity of one or more oil soluble molybdenum compound(s) effective to produce a molybdenum concentration of more than 360 ppm, as measured by X-ray fluorescence;

an amount of anti-wear component comprising zinc effective to produce a zinc concentration of about 1400 ppm or more, as measured by X-ray fluorescence; and, a quantity of a combination of esters effective to maintain the racing oil components in solution in the base oil, the combination including one or more multiester(s) selected from the group consisting of tricarboxylic acid triesters;

one or more detergent comprising metal having a valence of +2;

one or more dispersant comprising nitrogen; and, one or more antioxidant selected from the group consisting of aminic antioxidant, phenolic antioxidant, and combinations thereof; and, one or more antifoaming agent.

40. The method of claim 39 further comprising:

providing as said combination of esters a combination comprising one or more multiester(s) and one or more polyol monoester(s);

providing one or more compounds selected from the group consisting of molybdenum dithiocarbamates and molybdenum dithiophosphates as said one or more oil-soluble molybdenum compound(s);

providing one or more component(s) selected from the group consisting of zinc dihydrocarbyl dithiophosphates and zinc dihydrocarbyl dithiocarbamates as said one or more anti-wear component(s) comprising zinc.

41. The method of claim 40 wherein said anti-wear component produces a zinc concentration of from about 1500 ppm to about 2600 ppm or less; and, said oil-soluble molybdenum compound produces a molybdenum concentration of about 500 ppm or more.

42. The method of claim 41 further comprising when the base oil has a viscosity of from about 2 to about 10 cSt at 100° C., further providing at least one multiester selected from the group consisting of diester(s) having the following general structure:

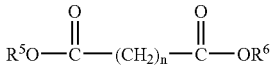

wherein n is from about 4 to about 10;

$R^5$ and $R^6$ are selected from the group consisting of alkyl groups and alkenyl groups having about carbon atoms or more; and, when the base oil has a viscosity of about 10 cSt or more at 100° C., providing said one or more multiester(s) comprising aromatic carboxylic acid triester(s).

43. The method of claim 42 wherein the base oil has a viscosity of about 10 cSt or more at 100° C., the method further comprising providing aromatic tricarboxylic acid triester(s) as said one or more multiester(s).

44. The method of claim 41 further comprising providing said one or more multiester(s) selected from the group consisting of isodecyl trimellitate, tridecyl trimellitate, and combinations thereof; and said one or more polyol monoester(s) selected from the group consisting of glycerol monoesters, trimethylolpropane monoesters, and pentaerythritol monoesters.

45. The method of claim 39 further comprising providing glycerol monooleate as said one or more polyol monoester(s).

46. The method of claim 44 further comprising providing glycerol monooleate as said one or more polyol monoester(s).

* * * * *